US012630997B2

(12) United States Patent
Honda et al.

(10) Patent No.: US 12,630,997 B2
(45) Date of Patent: May 19, 2026

(54) EXCAVATOR AND EXCAVATOR CONTROL SYSTEM

(71) Applicant: SUMITOMO CONSTRUCTION MACHINERY CO., LTD., Tokyo (JP)

(72) Inventors: Keiji Honda, Chiba (JP); Takeya Izumikawa, Chiba (JP)

(73) Assignee: SUMITOMO CONSTRUCTION MACHINERY CO., LTD., Tokyo (JP)

( * ) Notice: Subject to any disclaimer, the term of this patent is extended or adjusted under 35 U.S.C. 154(b) by 60 days.

(21) Appl. No.: 18/978,460

(22) Filed: Dec. 12, 2024

(65) Prior Publication Data

US 2025/0215660 A1 Jul. 3, 2025

(30) Foreign Application Priority Data

Dec. 28, 2023 (JP) ..... 2023-223244

(51) Int. Cl.

| | |
|---|---|
| ***E02F 3/43*** | (2006.01) |
| ***E02F 3/32*** | (2006.01) |
| ***E02F 9/20*** | (2006.01) |
| ***E02F 9/26*** | (2006.01) |
| *E02F 9/22* | (2006.01) |

(52) U.S. Cl.

CPC ..... *E02F 3/435* (2013.01); *E02F 3/32* (2013.01); *E02F 9/2004* (2013.01); *E02F 9/262* (2013.01); *E02F 9/205* (2013.01); *E02F 9/2203* (2013.01); *E02F 9/2285* (2013.01); *E02F 9/2292* (2013.01); *E02F 9/2296* (2013.01)

(58) Field of Classification Search

CPC . E02F 3/435; E02F 3/32; E02F 9/2004; E02F 9/262; E02F 9/205; E02F 9/2203; E02F 9/2285; E02F 9/2292; E02F 9/2296; E02F 9/2033; E02F 9/2228; E02F 9/2282; E02F 9/265; E02F 3/283

See application file for complete search history.

(56) References Cited

U.S. PATENT DOCUMENTS

| | | | | |
|---|---|---|---|---|
| 2015/0039189 | A1 | 2/2015 | Wu | |
| 2018/0016768 | A1* | 1/2018 | Izumikawa | E02F 3/439 |
| 2018/0016771 | A1* | 1/2018 | Izumikawa | E02F 9/264 |

FOREIGN PATENT DOCUMENTS

| | | |
|---|---|---|
| JP | 2020-029769 | 2/2020 |

* cited by examiner

*Primary Examiner* — Adam R Mott
*Assistant Examiner* — Sagar Kc
(74) *Attorney, Agent, or Firm* — IPUSA, PLLC

(57) ABSTRACT

An excavator includes a lower traveling body; an upper slewing body that is slewably mounted on the lower traveling body; a boom that is attached to the upper slewing body; an arm that is attached to an end of the boom; an end attachment that is attached to an end of the arm; a tilt sensor configured to detect a tilt of the excavator; and a control part configured to control a height of the end attachment during slewing of the upper 10 slewing body, in accordance with a detection result obtained by the tilt sensor.

15 Claims, 10 Drawing Sheets

SYS

EXCAVATOR AND EXCAVATOR CONTROL SYSTEM

CROSS-REFERENCE TO RELATED APPLICATIONS

This application is based upon and claims priority to Japanese Patent Application No. 2023-223244, filed on Dec. 28, 2023, the entire contents of which are incorporated herein by reference.

BACKGROUND

1. Technical Field

The present disclosure relates to an excavator and an excavator control system.

2. Description of Related Art

Techniques of facilitating operations performed by an operator when performing shaping with an excavator are known.

SUMMARY

An excavator according to an aspect of the present disclosure includes: a lower traveling body; an upper slewing body that is slewably mounted on the lower traveling body; a boom that is attached to the upper slewing body; an arm that is attached to an end of the boom; an end attachment that is attached to an end of the arm; a tilt sensor configured to detect a tilt of the excavator; and a control part configured to control a height of the end attachment during slewing of the upper slewing body, in accordance with a detection result obtained by the tilt sensor.

DETAILED DESCRIPTION

The above-described existing techniques consider only a case of drawing a straight line or leveling the ground along an extending direction of a front attachment. However, there is a need to level the ground with a side surface of an end attachment during slewing in an excavator. When the excavator is tilted with respect to a target plane upon leveling the ground, it is necessary to adjust the height of the end attachment in accordance with a slewing state of the excavator. The adjustment of the height of the end attachment is burdensome for an operator.

In one aspect of the present disclosure, an operator's operational burden is reduced by controlling the height of an end attachment during slewing when an excavator is tilted.

Hereinafter, embodiments of the present disclosure will be described with reference to the drawings. The embodiments as described below do not limit the present disclosure but are illustrative. All of the features described in the embodiments and combinations of the features are not necessarily essential to the present disclosure. Throughout the drawings, the same or corresponding components are denoted by the same or corresponding symbols, and description may be omitted.

In the following, the embodiments of the present disclosure will be described with examples in which an excavator is used as an example of a work machine. However, the present disclosure does not limit the work machine to an excavator. The present disclosure may be applicable to a construction machine, a standard machine, an applied machine, a forestry machine, or a conveyance machine based on a hydraulic excavator.

One Embodiment

Figure 1:
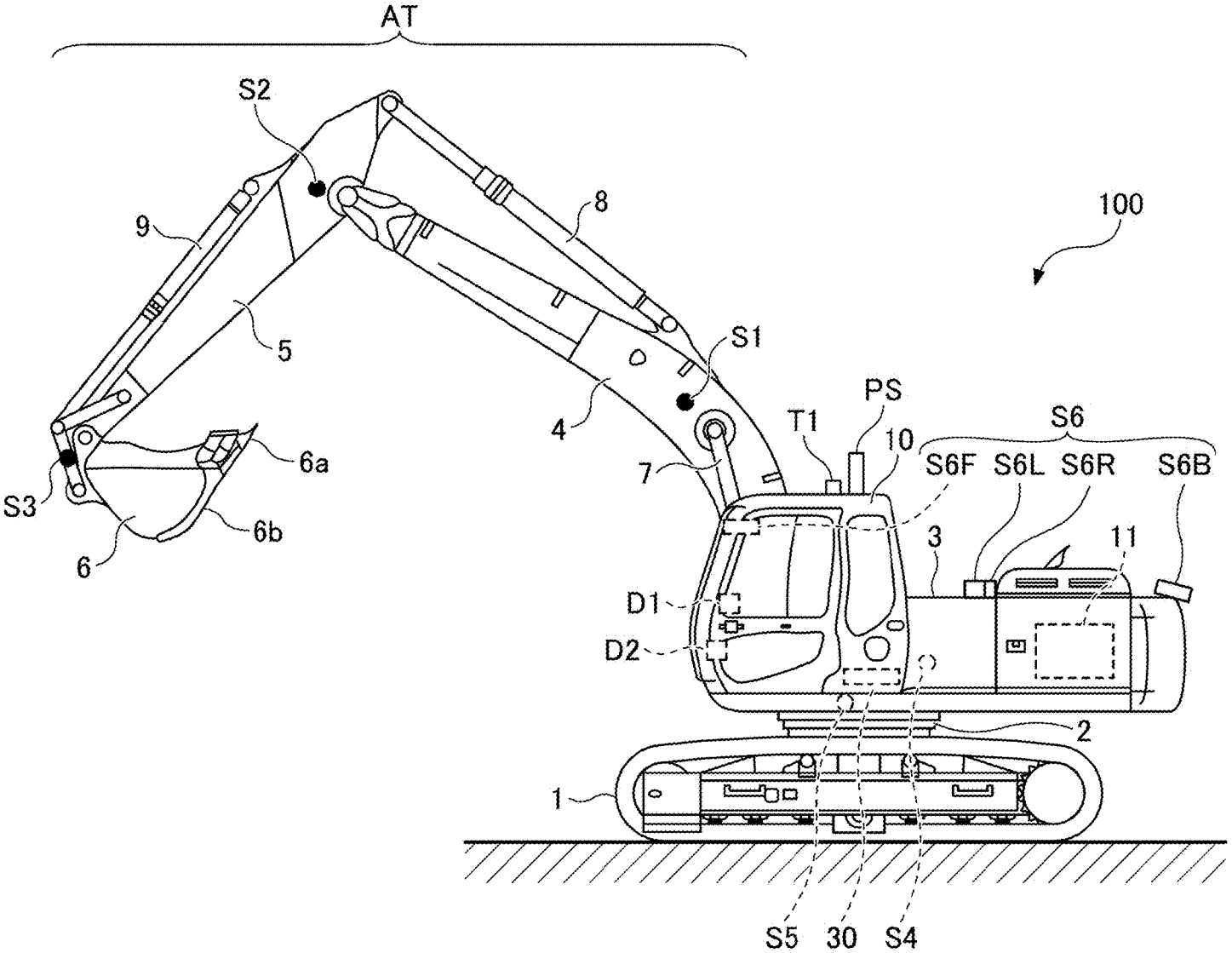
FIG. 1 is a side view of an excavator according to one embodiment.

First, an outline of an excavator 100 according to the present embodiment will be described with reference to FIG. 1. FIG. 1 is a side view of the excavator 100 according to the present embodiment.

The excavator 100 according to the present embodiment includes: a lower traveling body 1; an upper slewing body 3 that is slewably mounted via a slewing mechanism 2 on the lower traveling body 1; a boom 4, an arm 5, and a bucket 6, serving as attachments; and a cab 10.

The lower traveling body 1 includes, for example, a pair of left and right crawlers. The crawlers are hydraulically driven by hydraulic motors 2ML and 2MR for traveling (see FIG. 2), thereby causing the excavator 100 to travel.

The upper slewing body 3 is driven by a hydraulic motor 2A for slewing (see FIG. 2), thereby slewing with respect to the lower traveling body 1.

An attachment AT (an example of the attachment) includes the boom 4, the arm 5, and the bucket 6.

The boom 4 is mounted on a front center of the upper slewing body 3 such that the boom 4 can be elevated. The arm 5 is mounted on the end of the boom 4 so as to be vertically rotatable. The bucket 6 is mounted on the end of the arm 5 so as to be vertically rotatable.

The bucket 6 is an example of a working tool. The bucket 6 is used, for example, for excavating work. The bucket 6 according to the present embodiment includes a cutting edge 6*a* and a back surface 6*b* as portions forming a horizontal plane.

In addition, a working tool different from the bucket 6 may be attached to the end of the arm 5, for example, in accordance with the contents of the work. The different working tool may be a bucket of another type, such as a large bucket, a bucket for slope formation, a bucket for dredging, or the like. The different working tool may also be a working tool other than a bucket, such as an agitator, a breaker, a grapple, or the like.

Figure 2:
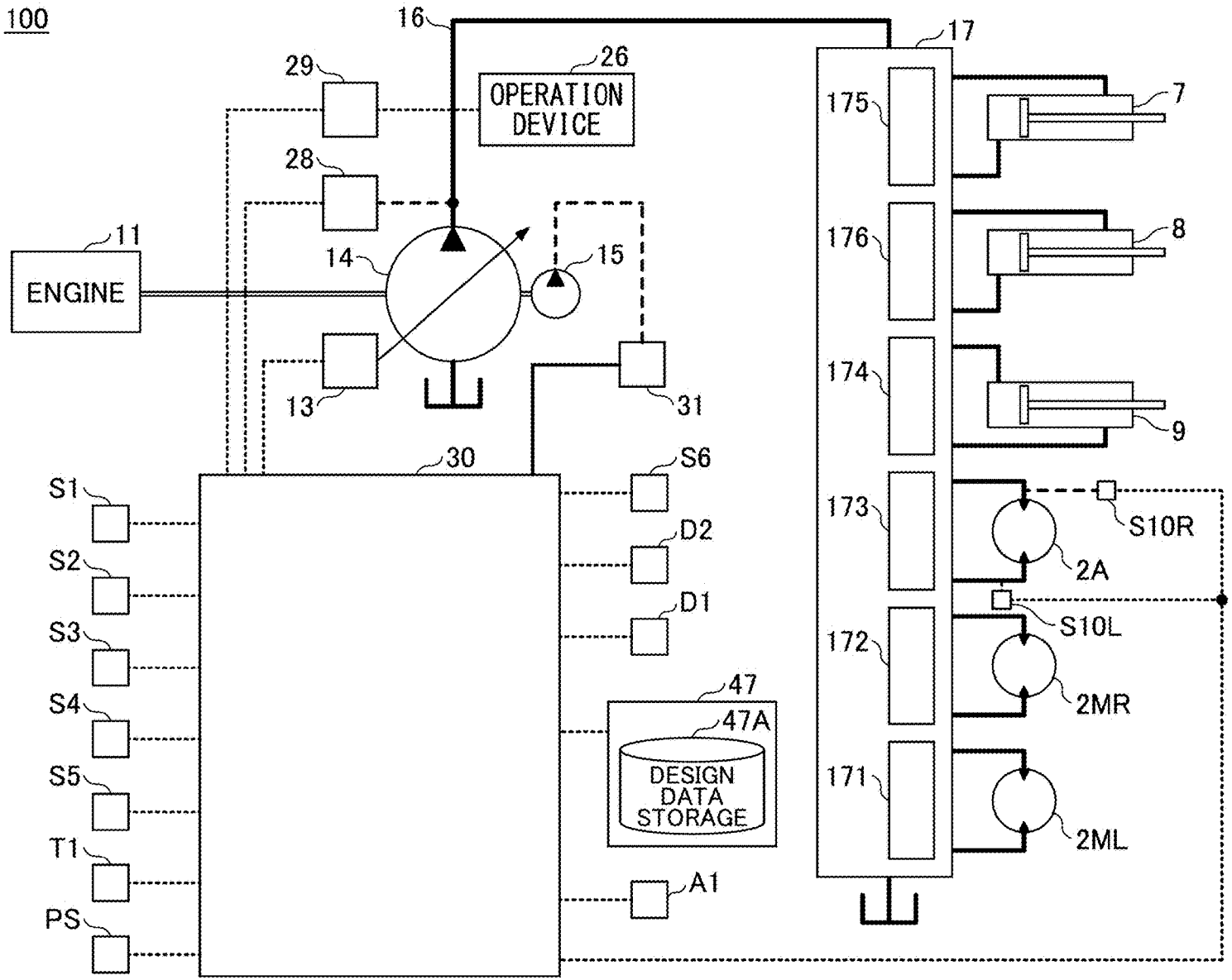
FIG. 2 is a block diagram illustrating an example of the configuration of an excavator according to the one embodiment.

The boom 4, the arm 5, and the bucket 6 are hydraulically driven by a boom cylinder 7, an arm cylinder 8, and a bucket cylinder 9, serving as hydraulic actuators, by use of hydraulic oil that is discharged from a main pump 14 (see FIG. 2).

The cab 10 is an operating room in which an operator rides, and is mounted on a front-left side of the upper slewing body 3.

The excavator 100 may be configured such that some of the driven components, such as the lower traveling body 1, the upper slewing body 3, the boom 4, the arm 5, the bucket 6, and the like, are electrically driven. That is, the excavator 100 may be a hybrid excavator, an electric excavator, or the like, in which some of the driven components are driven by electric actuators.

[Configuration of Excavator]

Next, a specific configuration of the excavator 100 will be described with reference to FIG. 2 in addition to FIG. 1.

FIG. 2 is a block diagram illustrating an example of the configuration of the excavator 100 according to the present embodiment.

In the drawings, a mechanical power line is denoted by a double line, a high-pressure hydraulic line is denoted by a solid line, a pilot line is denoted by a dashed line, and an electric drive control line is denoted by a dotted line.

A hydraulic drive system configured to hydraulically drive the hydraulic actuators of the excavator 100 according to the present embodiment includes an engine 11, a regulator 13, the main pump 14, and a control valve unit 17. As described above, the hydraulic drive system of the excavator 100 according to the present embodiment includes the hydraulic motors 2ML and 2MR for traveling, the hydraulic motor 2A for slewing, the boom cylinder 7, the arm cylinder 8, the bucket cylinder 9, and the like, which are configured to hydraulically drive the lower traveling body 1, the upper slewing body 3, the boom 4, the arm 5, and the bucket 6.

The engine 11 is a main power source in the hydraulic drive system, and is mounted, for example, on the rear of the upper slewing body 3. Specifically, the engine 11 rotates at a predetermined target rotation speed under direct or indirect control of a controller 30, which will be described below, thereby driving the main pump 14 and a pilot pump 15. The engine 11 is, for example, a diesel engine using diesel fuel.

The regulator 13 controls the discharge amount of the main pump 14. For example, the regulator 13 adjusts the angle (tilt angle) of a swash plate of the main pump 14 in accordance with a control command from the controller 30.

Similar to the engine 11, the main pump 14 (an example of the hydraulic pump) is, for example, mounted on the rear of the upper slewing body 3, and is configured to supply hydraulic oil to the control valve unit 17 through a high-pressure hydraulic line 16. As described above, the main pump 14 is driven by the engine 11. The main pump 14 is, for example, a variable displacement hydraulic pump. When the regulator 13 adjusts the tilt angle of the swash plate under control of the controller 30 as described above, the stroke length of a piston is adjusted, thereby controlling the discharge flow rate (discharge pressure).

The control valve unit 17 is a hydraulic control device configured to control a hydraulic system in the excavator 100. In the present embodiment, the control valve unit 17 includes control valves 171 to 176. The control valve unit 17 is configured to selectively supply hydraulic oil, discharged from the main pump 14, to one or more hydraulic actuators through the control valves 171 to 176. The control valves 171 to 176 control, for example, the flow rate of hydraulic oil flowing from the main pump 14 to the hydraulic actuator, and the flow rate of hydraulic oil flowing from the hydraulic actuator to a hydraulic oil tank. The hydraulic actuator includes the boom cylinder 7, the arm cylinder 8, the bucket cylinder 9, the hydraulic motors 2ML and 2MR for traveling, and the hydraulic motor 2A for slewing. More specifically, the control valve 171 corresponds to the left hydraulic motor 2ML for traveling, the control valve 172 corresponds to the right hydraulic motor 2MR for traveling, and the control valve 173 corresponds to the hydraulic motor 2A for slewing. The control valve 174 corresponds to the bucket cylinder 9, the control valve 175 corresponds to the boom cylinder 7, and the control valve 176 corresponds to the arm cylinder 8.

The pilot pump 15 is an example of a pilot pressure generating device, and is configured to supply hydraulic oil to a hydraulic pressure control device through a pilot line. In the present embodiment, the pilot pump 15 is a fixed displacement hydraulic pump. However, the pilot pressure generating device may be achieved by the main pump 14. That is, in addition to the function of supplying hydraulic oil to the control valve unit 17 through a hydraulic oil line, the main pump 14 may have the function of supplying hydraulic oil to various hydraulic pressure control devices through the pilot line. In this case, the pilot pump 15 may be omitted.

A discharge pressure sensor 28 is configured to detect the discharge pressure of the main pump 14. In the present embodiment, the discharge pressure sensor 28 outputs a detected value to the controller 30.

An operation device 26 is a device used for an operator to operate an actuator. The operation device 26 includes, for example, an operating lever and an operating pedal. The actuator includes a hydraulic actuator, an electric actuator, or both.

A proportional valve 31, serving as a control valve for machine control, is disposed in a conduit connecting the pilot pump 15 and a pilot port of the control valve in the control valve unit 17. The proportional valve 31 is configured so as to change the flow path area of the conduit. In the present embodiment, the proportional valve 31 is driven in response to a control command output by the controller 30. Therefore, the controller 30 can supply the hydraulic oil, discharged by the pilot pump 15, to the pilot port of the control valve in the control valve unit 17 via the proportional valve 31, independently of an operation performed by an operator on the operation device 26.

With this configuration, even if no operation is performed on the specific operation device 26, the controller 30 can drive the hydraulic actuator corresponding to the specific operation device 26.

The control system of the excavator 100 according to the present embodiment includes the controller 30, an auxiliary storage device 47, a display device D1, an input device D2, a speaker A1, and a communication device T1. The control system of the excavator 100 includes the proportional valve 31, a boom angle sensor S1, an arm angle sensor S2, a bucket angle sensor S3, a machine body tilt sensor S4, a slewing angle sensor S5, a photographing device S6, and a positioning device PS, as components of a semi-automatic driving function.

An operation sensor 29 is configured to detect an operation content of the operator using the operation device 26. In the present embodiment, the operation sensor 29 detects the direction and the amount of the operation on the operation device 26 corresponding to each of the actuators, and outputs a detected value to the controller 30. In the present embodiment, the controller 30 controls an opening area of a proportional valve 31 in accordance with the output of the operation sensor 29. The controller 30 feeds the hydraulic oil discharged by the pilot pump 15 to pilot ports of corresponding control valves in the control valve unit 17. The pressure (pilot pressure) of the hydraulic oil fed to each of the pilot ports is, in principle, a pressure in accordance with the direction and the amount of the operation on the operation device 26 corresponding to each of the hydraulic actuators. In this manner, the operation device 26 is configured to feed the hydraulic oil discharged by the pilot pump 15 to the pilot ports of the corresponding control valves in the control valve unit 17.

The display device D1 is provided in the cab 10 in a place where a seated operator can readily see the display device D1. The display device D1 displays images of various information under control of the controller 30. The display device D1 may be connected to the controller 30 through an on-vehicle communication network, such as a controller area network (CAN) or the like, or may be connected to the controller 30 through a one-to-one dedicated line.

The display device D1 is not limited to a device that is previously provided in the cab 10, and may be a monitor that can be provided separately. Further, the display device D1 may be any device as long as a selected device is configured to perform display. For example, the display device D1 may be a tablet terminal or the like configured to communicate with the communication device T1.

The input device D2 is provided within reach of a seated operator in the cab 10, receives inputs of various operations from the operator, and outputs signals corresponding to the inputs to the controller 30. The input device D2 includes a touch panel mounted on the display of the display device configured to display images of various information, a knob switch provided at the end of the lever of the operation device 26, and a button switch, a lever, a toggle, a rotary dial, and the like that are disposed around the display device D1. A signal corresponding to the operation contents of the input device D2 is taken into the controller 30.

The speaker A1 is provided, for example, in the cab 10. The speaker A1 is configured to convert, and then output, a sound signal input from the controller 30, into a physical sound, in other words, into an air vibration. The speaker A1 may be provided at a desired position, for example, near the display device D1, near the input device D2, or near the door of the cabin.

The auxiliary storage device 47 is a readable and writable non-volatile storage medium, and includes a design data storage 47A.

The design data storage 47A is configured to store design data. The design data includes construction data indicating a three-dimensional shape after construction by the excavator 100 at a work site. The construction data includes position data of a construction target in the world geodetic system indicated by a global navigation satellite system (GNSS), and three-dimensional shape data after construction. For example, the design data includes position data and three-dimensional shape data of a work target plane formed after earth and sand are scraped by the excavator 100.

The position data is expressed in a reference coordinate system similar to that for position data obtained by a GNSS. The reference coordinate system is, for example, the world geodetic system. The world geodetic system is a three-dimensional orthogonal XYZ coordinate system in which the origin is set at the center of gravity of the globe, the X axis is taken in a direction toward the intersection between the Greenwich meridian and the equator, the Y axis is taken in a direction at 90 degrees of the east longitude, and the Z axis is taken in a direction toward the North Pole.

The controller 30 (an example of the control device or the control part) is, for example, provided in the cab 10. The controller 30 controls driving of the excavator 100. The function of the controller 30 may be achieved by desired hardware, desired software, or a combination of the hardware and the software. For example, the controller 30 is mainly configured by a microcomputer including a central processing unit (CPU), a read only memory (ROM), a random access memory (RAM), a non-volatile auxiliary storage medium, various input/output interfaces, and the like. For example, the controller 30 achieves various functions by executing, on the CPU, various programs stored in a ROM or a non-volatile auxiliary storage medium.

For example, the controller 30 sets a target rotation speed in accordance with an operation or the like performed by an operator or the like, and controls driving of the engine 11 so as to rotate at a constant rotation speed.

For example, the controller 30 outputs a control command to the regulator 13 if necessary, thereby changing the discharge amount of the main pump 14.

Further, for example, the controller 30 controls the regulator 13, for example, in accordance with the detected values of the pilot pressures input from the operation sensor 29 and corresponding to the operating states of various operating components (i.e., various hydraulic actuators) in the operation device 26, thereby adjusting the discharge amount of the main pump 14.

Also, for example, the controller 30 performs, for example, control in relation to a machine guidance function that guides an operator's manual operation of the excavator 100 through the operation device 26. Also, the controller 30 performs, for example, control in relation to a machine control function that automatically supports an operator's manual operation of the excavator 100 through the operation device 26.

Some of the functions of the controller 30 may be achieved by another controller (control device). In other words, the functions of the controller 30 may be achieved in a distributed manner by a plurality of controllers. For example, the machine guidance function and the machine control function may be achieved by dedicated controllers (control devices).

More specifically, the controller 30 obtains information from the boom angle sensor S1, the arm angle sensor S2, the bucket angle sensor S3, the machine body tilt sensor S4, the slewing angle sensor S5, the photographing device S6, the communication device T1, the positioning device PS, the input device D2, and the like. The controller 30 calculates, for example, the distance between the bucket 6 and the design plane, indicated by the design data stored in the design data storage 47A, in accordance with the obtained information. The controller 30 appropriately controls the proportional valve 31, for example, in accordance with the calculated distance between the bucket 6 and the design plane, and individually and automatically adjusts the pilot pressure applied to the control valves corresponding to the hydraulic actuators, thereby automatically driving the actuators.

The proportional valve 31 is provided in a pilot line connecting the pilot pump 15 and the pilot port of the control valves 171 to 176, and is configured to change the flow path area (i.e., the cross-sectional area through which hydraulic oil can flow). The proportional valve 31 is driven in response to a control command input from the controller 30. Thus, even if the operation device 26 is not operated by the operator, the controller 30 can supply the hydraulic oil, discharged by the pilot pump 15, to the pilot port of a corresponding control valve in the control valve unit 17 via the proportional valve 31. The controller 30 can apply the pilot pressure, generated by the proportional valve 31, to the pilot port of the corresponding control valve.

With this configuration, even if the specific operation device 26 is not operated, the controller 30 can drive the hydraulic actuator corresponding to the specific operation device 26. Also, even if the specific operation device 26 is operated, the controller 30 can forcibly stop driving of the hydraulic actuator corresponding to the specific operation device 26.

The boom angle sensor S1 is attached to the boom 4, and is configured to detect an elevation angle of the boom 4 with respect to the upper slewing body 3 (hereinafter referred to as a "boom angle"), e.g., an angle that is formed, in a side view, by a straight line connecting the fulcrums at both ends of the boom 4 with respect to a slewing plane of the upper slewing body 3. The boom angle sensor S1 may include, for example, a rotary encoder, an acceleration sensor, a 6-axis sensor, an inertial measurement unit (IMU), and the like. Also, the boom angle sensor S1 may include a potentiometer using a variable resistor, a cylinder stroke sensor configured to detect the amount of stroke of a hydraulic cylinder (the boom cylinder 7) corresponding to the boom angle, and the like. The same applies to the arm angle sensor S2, the bucket angle sensor S3, and a machine body tilt sensor S4. A detection signal corresponding to the boom angle obtained by the boom angle sensor S1 is taken into the controller 30.

The arm angle sensor S2 is attached to the arm 5, and is configured to detect a rotation angle of the arm 5 with respect to the boom 4 (hereinafter referred to as an "arm angle"), e.g., an angle that is formed, in a side view, by a straight line connecting the fulcrums at both ends of the arm 5 with respect to a straight line connecting the fulcrums at both ends of the boom 4. A detection signal corresponding to the arm angle obtained by the arm angle sensor S2 is taken into the controller 30.

The bucket angle sensor S3 is attached to the bucket 6, and is configured to detect a rotation angle of the bucket 6 with respect to the arm 5 (hereinafter referred to as a "bucket angle"), e.g., an angle that is formed, in a side view, by a straight line connecting the fulcrum and the end (cutting end) of the bucket 6 with respect to a straight line connecting the fulcrums at both ends of the arm 5. A detection signal corresponding to the bucket angle obtained by the bucket angle sensor S3 is taken into the controller 30.

In the present embodiment, the boom angle sensor S1, the arm angle sensor S2, and the bucket angle sensor S3 are also referred to as an angle sensor of the attachment AT. The detection result obtained by the angle sensor of the attachment AT is also referred to as an angle of the attachment AT. The angle of the attachment AT indicates, for example, the boom angle, the arm angle, and the bucket angle.

The machine body tilt sensor S4 is configured to detect a state of how the machine body (the upper slewing body 3 or the lower traveling body 1) is tilted with respect to the horizontal plane. The machine body tilt sensor S4 is attached, for example, to the upper slewing body 3, and detects tilt angles of the excavator 100 (i.e., the upper slewing body 3) about two axes in the front-rear direction and the left-right direction (hereinafter referred to as a "front-rear tilt angle" and a "left-right tilt angle"). Detection signals corresponding to the tilt angles (the front-rear tilt angle and the left-right tilt angle) obtained by the machine body tilt sensor S4 are taken into the controller 30.

The slewing angle sensor S5 is configured to output detection information about the slewing state of the upper slewing body 3. For example, the slewing angle sensor S5 detects a slewing angular velocity and a slewing angle of the upper slewing body 3. Examples of the slewing angle sensor S5 include a gyro sensor, a resolver, a rotary encoder, and the like.

The present embodiment is described using an example in which the slewing angle sensor S5 is used. However, the present embodiment does not intend any limitation to the method using the slewing angle sensor S5. For example, an inertial measurement unit (IMU) sensor may be used instead of the slewing angle sensor S5. Further, instead of the slewing angle sensor S5, the positioning device PS, which will be described below, may detect the orientation of the excavator 100. Further, instead of the slewing angle sensor S5, a geomagnetic sensor may be used.

The photographing device S6 is configured to photograph the surroundings of the excavator 100. The photographing device S6 includes a camera S6F configured to photograph a space frontward of the excavator 100, a camera S6L configured to photograph a space leftward of the excavator 100, a camera S6R configured to photograph a space rightward of the excavator 100, and a camera S6B configured to photograph a space rearward of the excavator 100.

The camera S6F is mounted, for example, on the ceiling of the cab 10, i.e., inside the cab 10. The camera S6F may be mounted outside the cab 10, such as, for example, on the roof of the cab 10 or on the side surface of the boom 4. The camera S6L is mounted on the left end of the upper surface of the upper slewing body 3, the camera S6R is mounted on the right end of the upper surface of the upper slewing body 3, and the camera S6B is mounted on the rear end of the upper surface of the upper slewing body 3.

The photographing device S6 (the cameras S6F, S6B, S6L, and S6R) is, for example, a monocular wide-angle camera having a very wide angle of view. The photographing device S6 may be a stereo camera, a distance image camera, or the like. The photographed image obtained by the photographing device S6 is taken into the controller 30.

The positioning device PS is configured to obtain information about the position of the excavator 100. In the present embodiment, the positioning device PS is configured to measure the position and the orientation of the excavator 100. Specifically, the positioning device PS is a GNSS receiver including an electronic compass, and is configured to measure the latitude, the longitude, and the altitude of the current position of the excavator 100, and the orientation of the excavator 100.

The hydraulic motor 2A for slewing according to the present embodiment is provided with a rightward slewing pressure sensor S10R and a leftward slewing pressure sensor S10L.

The rightward slewing pressure sensor S10R is configured to detect the pressure of hydraulic oil in the right port of the hydraulic motor 2A for slewing. The leftward slewing pressure sensor S10L is configured to detect the pressure of hydraulic oil in the left port of the hydraulic motor 2A for slewing.

The communication device T1 is configured to communicate with external devices through a predetermined network including a mobile communication network in which a base station is a terminal, a satellite communication network, an Internet network, or the like. The communication device T1 is, for example, a mobile communication module compliant with a mobile communication standard, such as long term evolution (LTE), 4G ($4^{th}$ Generation), 5G ($5^{th}$ Generation), or the like; or a satellite communication module for connection to a satellite communication network.

In response to receiving an operation performed by an operator in the cab 10, the excavator 100 drives actuators (e.g., hydraulic actuators) to drive moving components (hereinafter referred to as "driven components"), such as the lower traveling body 1, the upper slewing body 3, the boom 4, the arm 5, the bucket 6, and the like.

In addition to or instead of being configured to be operable by an operator of the cab 10, the excavator 100 may be configured to be remotely operable (remote operation) from the exterior of the excavator 100. When the excavator 100 is remotely operated, the cab 10 need not include an operator.

The excavator 100 may automatically drive the actuators regardless of the operation contents of the operator. Thus, the excavator 100 achieves the function of automatically driving at least some of the driven components, such as the lower traveling body 1, the upper slewing body 3, the boom 4, the arm 5, the bucket 6, and the like, i.e., what is referred to as an "automatic driving function" or a "machine control function".

The automatic driving function may include the function of automatically driving a driven component (actuator) other than the driven component (actuator) to be driven in response to an operation performed by an operator on the operation device 26 or a remote operation, i.e., what is referred to as a "semi-automatic driving function" or an "operation-supported machine control function". Also, the automatic driving function may include the function of automatically driving at least some of the plurality of driven elements (hydraulic actuators) on the assumption that there is not an operation performed by an operator on the operation device 26 or a remote operation, i.e., what is referred to as a "fully automatic driving function" or a "fully automatic machine control function". When the fully automatic operation function is active in the excavator 100, the cab 10 need not include a human. The semi-automatic driving function, the fully automatic driving function, and the like may include a mode in which the operation content of the driven component (actuator) to be driven is automatically determined in accordance with a predetermined rule. The semi-automatic driving function, the fully automatic driving function, and the like may include a mode in which the excavator 100 autonomously performs various determinations, and autonomously determines the operation content of the driven element (hydraulic actuator) to be driven in accordance with the determination result (what is referred to as an "automatic driving function").

Specifically, when the arm 5 is driven by the operator through the operation device 26, the controller 30 may automatically drive at least one of the boom 4 or the bucket 6 such that a predetermined target design plane (hereinafter referred to simply as a "design plane") coincides with the end position of the bucket 6. Also, the controller 30 may automatically drive the arm 5 independently of the operating state of the operation device 26 operating the arm 5. That is, the controller 30 may cause the attachment to move in a predetermined manner by using, as a trigger, an operation performed by the operator on the operation device 26. In the following, the function of the controller 30 that drives not only the arm 5 but also at least one of the boom 4 or the bucket 6 in response to an operation on the operation device 26 for the arm 5 will be referred to as a "semi-automatic driving function". The semi-automatic driving function may be performed, for example, by operating a predetermined switch (hereinafter referred to as a "machine control (MC) switch") disposed at the end of any lever included in the operation device 26.

[Functional Configuration of Controller]

Figure 3:
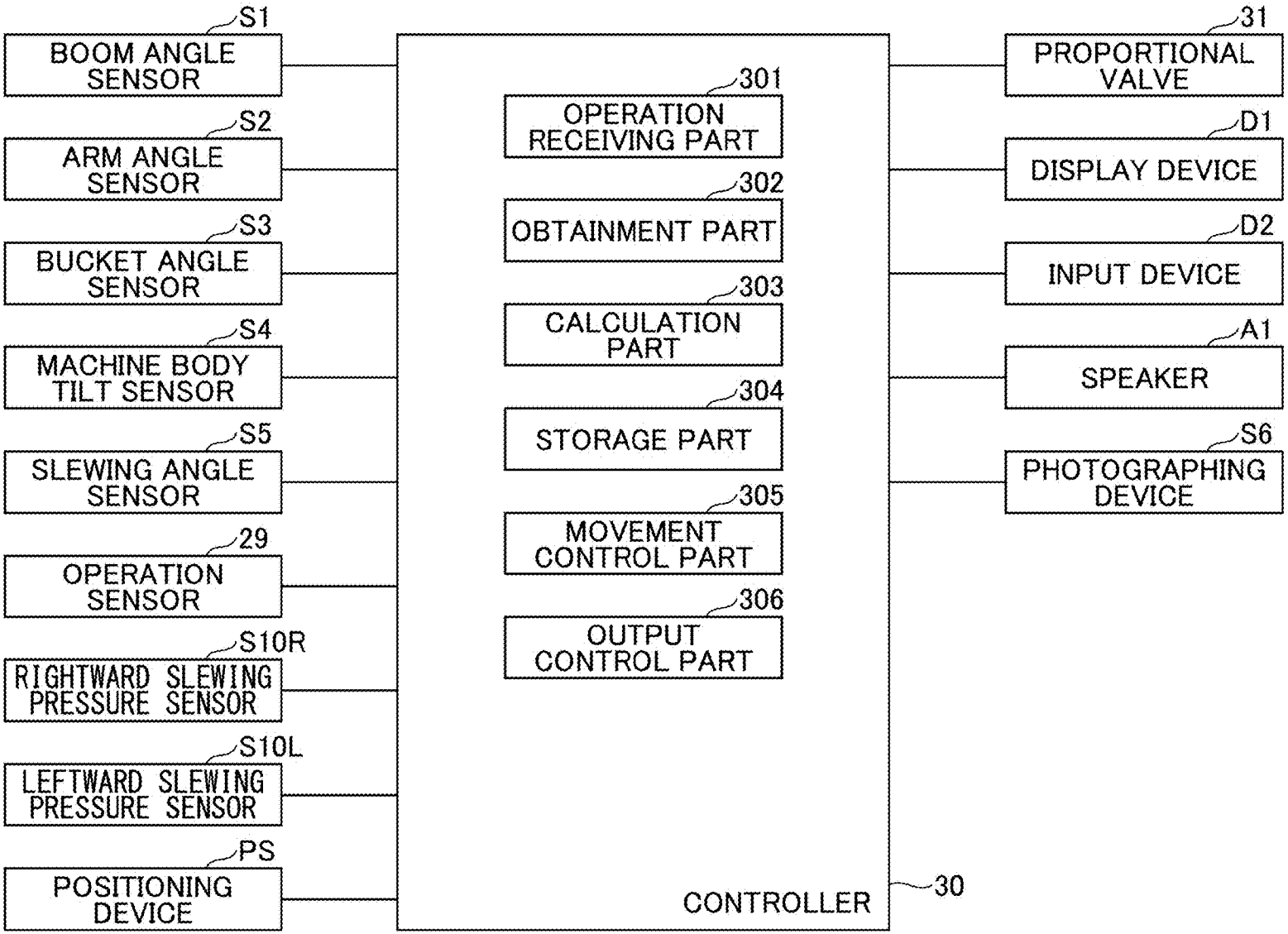
FIG. 3 is a diagram illustrating an example of the configuration of a controller according to the one embodiment.

Next, a configuration in which the controller 30 controls the height of the end attachment during slewing will be described with reference to FIG. 3. FIG. 3 is a diagram illustrating an example of the configuration of the controller 30 according to the present embodiment. As illustrated in FIG. 3, the controller 30 includes an operation receiving part 301, an obtainment part 302, a calculation part 303, a storage part 304, a movement control part 305, and an output control part 306.

The controller 30 according to the present embodiment may perform the machine control function, which automatically supports an operator's manual direct operation of the excavator 100 and an operator's manual remote operation of the excavator 100. For example, the controller 30 may automatically drive at least one of the boom 4, the arm 5, or the bucket 6 such that the target design plane matches the end position of the bucket 6 when the operator is manually performing an excavation operation.

The operation receiving part 301 is configured, for example, to receive, from the operation sensor 29, an operation signal indicating an operation direction and an operation amount of the operation device 26. Also, the operation receiving part 301 receives information indicating operation content from the input device D2.

For example, the operation receiving part 301 receives pressing of a predetermined switch included in the input device D2. The predetermined switch is, for example, a machine control switch (hereinafter referred to as an "MC switch") and may be disposed as a knob switch at the front end of the operation device 26. The present embodiment does not limit the position of the switch to be pressed to start the machine control function. The switch may be disposed at a position other than the operation device 26.

When the controller 30 according to the present embodiment receives pressing of the MC switch, the controller 30 executes the machine control function, which automatically supports the manual direct operation and the manual remote operation. For example, when the MC switch or the like is pressed, the controller 30 may automatically extend or contract at least one of the boom cylinder 7 or the bucket cylinder 9 in accordance with the movement of the arm cylinder 8 in order to support excavating work or shaping work.

The obtainment part 302 is configured to obtain detection results from various sensors provided to the excavator 100. For example, the obtainment part 302 obtains information from the boom angle sensor S1, the arm angle sensor S2, the bucket angle sensor S3, the machine body tilt sensor S4, the slewing angle sensor S5, the photographing device S6, the positioning device PS, the rightward slewing pressure sensor S10R, the leftward slewing pressure sensor S10L, and the like.

The calculation part 303 is configured to calculate the height of a predetermined portion of the bucket 6 from the ground. Specifically, in accordance with detection results of the boom angle sensor S1, the arm angle sensor S2, and the bucket angle sensor S3, and the dimensions of the attachment AT, the calculation part 303 calculates the positional coordinates of a predetermined portion of the bucket 6 in a relative coordinate system in which a predetermined position of the excavator 100 (e.g., the center position of the bottom surface of the excavator 100) is set as the origin and a plane on which the excavator 100 can travel is set as an XY plane. In the present embodiment, description will be given of a case in which the predetermined portion of the bucket 6 is the back surface 6*b* of the bucket 6. The predetermined portion of the bucket 6 is not limited to the back surface 6*b* of the bucket 6. The predetermined portion of the bucket 6 may be any portion as long as the predetermined portion serves as a reference for controlling the height of the bucket 6 during leveling of the ground. For example, the predetermined portion may be the cutting edge 6*a*.

Subsequently, the calculation part 303 converts the positional coordinates of (the center of) the back surface 6*b* of the bucket 6 in the relative coordinate system into the positional coordinates in the reference coordinate system described above. The calculation part 303 calculates the tilt angles (the front-rear tilt angle and the left-right tilt angle) of the relative coordinate system with respect to the reference coordinates, in accordance with the detection results obtained by the machine body tilt sensor S4. Then, the calculation part 303 converts the positional coordinates of (the center of) the back surface 6*b* of the bucket 6 in the relative coordinate system into the positional coordinates of the reference coordinate system, in accordance with the tilt angles and the positional coordinates of the reference coordinates corresponding to the origin of the relative coordinate system. Thus, the calculation part 303 can derive the height of the back surface 6*b* of the bucket 6 in the reference coordinate system.

The storage part 304 is configured to store the current state of the excavator 100 in the auxiliary storage device 47 as a setting for leveling the ground with the bucket 6. For example, the storage part 304 stores the tilt angle of the excavator 100 and the height of the back surface 6*b* of the bucket 6 in the auxiliary storage device 47 at the timing the MC switch is pressed. The height of the back surface 6*b* of the bucket 6 stored in the auxiliary storage device 47 is the height of a reference plane in which leveling with the bucket 6 is to be performed. The reference plane according to the present embodiment is an example of the horizontal plane in the reference coordinate system. That is, the reference plane in which leveling with the bucket 6 is to be performed a plane that does not change in height in the reference coordinate system. The height of the reference plane corresponds to the height of the ground after the ground is leveled with the bucket 6 during slewing. The present embodiment is described using a case in which the reference plane in which leveling is to be performed is the horizontal plane. However, the present embodiment does not intend any limitation to the case in which the reference plane is the horizontal plane. The reference plane may be tilted in the height direction in the reference coordinate system. That is, according to the present embodiment, the ground can be leveled so as to have a height of the reference plane.

The movement control part 305 is configured to control the movement of the excavator 100. For example, the movement control part 305 controls the height of the back surface 6*b* (an example of the predetermined portion) of the bucket 6 during slewing of the upper slewing body 3 in accordance with the detection result obtained by the machine body tilt sensor S4.

The output control part 306 is configured to perform control for displaying information about the display device D1. Specific examples of the information to be displayed will be described below.

Next, a specific example in which the controller 30 controls the height of the back surface 6*b* of the bucket 6 will be described.

Figure 4:
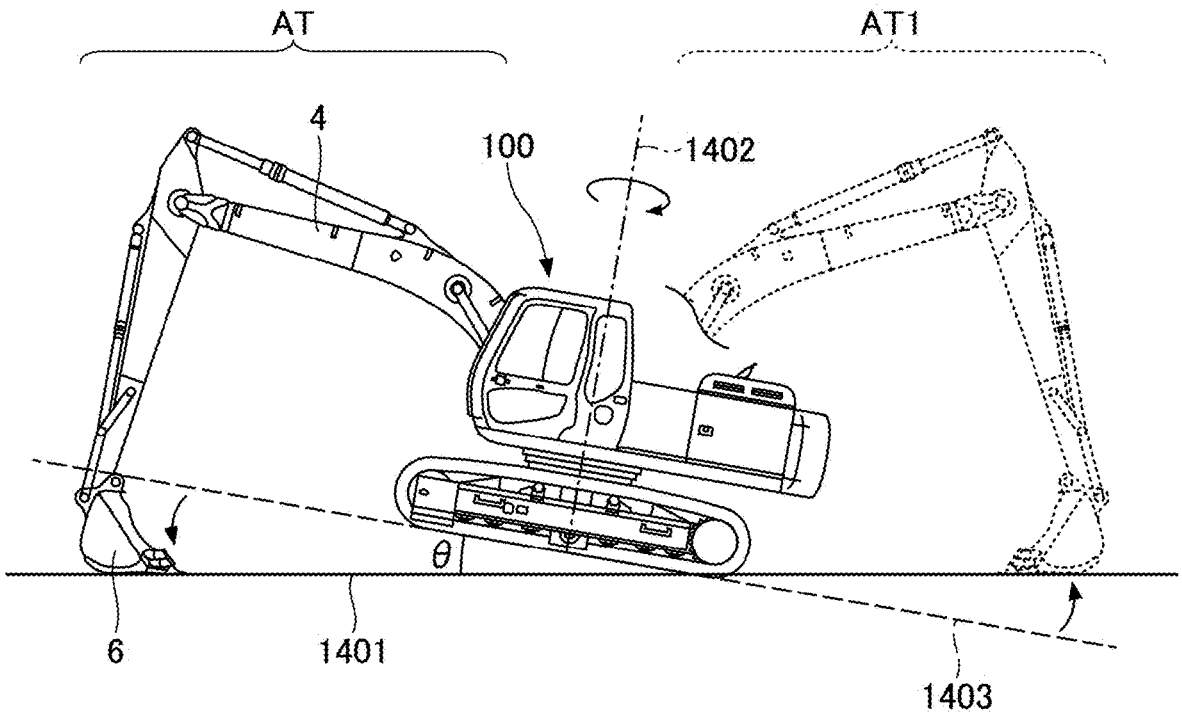
FIG. 4 is a diagram illustrating control of the height of a back surface of a bucket during slewing in the excavator according to the one embodiment.

FIG. 4 is a diagram illustrating control of the height of the back surface (an example of the predetermined portion) 6*b* of the bucket 6 during slewing in the excavator 100 according to the present embodiment. The excavator 100 illustrated in FIG. 4 is an example in which the excavator 100 levels ground 1401 with the side surface of the bucket 6 through slewing of the upper slewing body 3 in a state in which the back surface 6*b* of the bucket 6 is in contact with the ground (an example of the predetermined reference plane) 1401 to be leveled.

In the present embodiment, an operator operates the excavator 100 such that the back surface 6*b* of the bucket 6 contacts the ground 1401 to be leveled. Subsequently, the excavator 100 slews the upper slewing body 3 in accordance with an operation performed by the operator. During slewing in the excavator 100, the machine control function is executed. As a result, the side surface of the bucket 6 levels the ground by scraping the earth and sand above the ground 1401 to be leveled.

In the example illustrated in FIG. 4, the excavator 100 is tilted by a tilt angle θ with respect to the ground 1401 to be leveled. In this state, the upper slewing body 3 of the excavator 100 slews about a slewing axis 1402. When no control of the height of the bucket 6 is performed, the bucket 6 moves along a plane parallel to a plane 1403. That is, when the excavator 100 is tilted, it is demanding to move the bucket 6 along the ground 1401. In other words, in order to level the ground 1401 through slewing with the excavator 100 that is tilted, the height of the bucket 6 needs to be adjusted such that the back surface 6*b* of the bucket 6 is maintained to be in contact with the ground 1401.

Specifically, at the position of the attachment AT of the excavator 100 illustrated in FIG. 4, it is necessary to lower the boom 4 such that the bucket 6 becomes lower than the plane 1403 on which the excavator 100 can travel. On the other hand, at the position of an attachment AT1, it is necessary to raise the boom 4 such that the bucket 6 becomes higher than the plane 1403 on which the excavator 100 can travel.

Therefore, the movement control part 305 according to the present embodiment controls the movement of the boom 4 such that the height of the bucket 6 is maintained to be the height of the ground (an example of the predetermined reference plane) 1401 during slewing of the upper slewing body 3 while the machine control function is being performed. In other words, while the machine control function is being performed, the movement control part 305 suppresses excavating and compaction performed by the bucket 6 during slewing of the upper slewing body 3.

In the present embodiment, when the operation receiving part 301 receives an operation for slewing while receiving pressing of the MC switch (an example of the predetermined switch), the movement control part 305 controls the movement of the boom 4 such that the height of the bucket 6 is maintained to be the height of the ground (an example of the predetermined reference plane) 1401 during slewing of the upper slewing body 3. More specifically, the storage part 304 according to the present embodiment stores, in the auxiliary storage device 47, the height of the bucket 6 at the time of receiving pressing of the MC switch (an example of the predetermined switch) as the height of the ground to be leveled. While the operation receiving part 301 is receiving pressing of the MC switch, the movement control part 305 moves the boom 4 such that the stored height of the ground substantially coincides with the height of the back surface 6*b* of the bucket 6 during slewing of the upper slewing body 3. Thus, the height of the bucket 6 is adjusted along the ground to be leveled. In the present embodiment, the movement of the boom 4 is controlled by a simple operation performed by an operator, and therefore operability can be improved.

The present embodiment will be described using an example in which the height of the plane in which leveling with the bucket 6 is to be performed is determined in accordance with the position of the back surface 6*b* of the bucket 6 when the MC switch (an example of the predetermined switch) is pressed, i.e., when the machine control function is performed. This is by no means a limitation. For example, the controller 30 may determine the height of a plane of the ground to be leveled as a position that is lower by a predetermined distance (e.g., several centimeters) in the height direction than a plane with which the excavator 100 is in contact.

The present embodiment illustrates one mode of operation, and does not limit the pressing of the predetermined switch to be during the pressing of the MC switch. For example, the pressing of the predetermined switch may be pressing the predetermined switch one or more times.

The calculation part 303 calculates the height of the back surface 6*b* of the current bucket 6 in the reference coordinate system, in accordance with the slewing angle and the tilt angle that are obtained every predetermined cycle during the pressing of the MC switch and during slewing of the upper slewing body 3. The predetermined cycle may be, for example, a calculation cycle of the controller 30, or another calculation cycle.

Then, the movement control part 305 raises or lowers the boom 4 every predetermined cycle such that the calculated height of the back surface 6*b* substantially coincides with the height of the back surface 6*b* of the bucket 6 stored in the storage part 304. Also, the movement control part 305 opens or closes the bucket 6 every predetermined cycle such that the back surface 6*b* of the bucket 6 is substantially parallel to the ground to be leveled.

By the above-described control performed by the movement control part 305, the height of the back surface 6*b* of the bucket 6 is controlled such that earth and sand existing on the ground to be leveled can be removed with the side surface of the bucket 6 during slewing of the upper slewing body 3. In the present embodiment, an object to be removed with the side surface of the bucket 6 is not limited to earth and sand, and may be any object existing on the ground to be leveled. The present embodiment enables leveling of the ground through slewing, and thus the operator's operational burden can be reduced.

According to the present embodiment, even if the excavator 100 is tilted, the above-described control performed by the controller 30 enables removal of, for example, earth and sand existing on the ground and leveling of the ground through slewing with the back surface of the bucket 6 being in contact with the ground.

Further, the movement control part 305 controls the movement of the boom in accordance with a load applied during slewing.

Figure 5B:
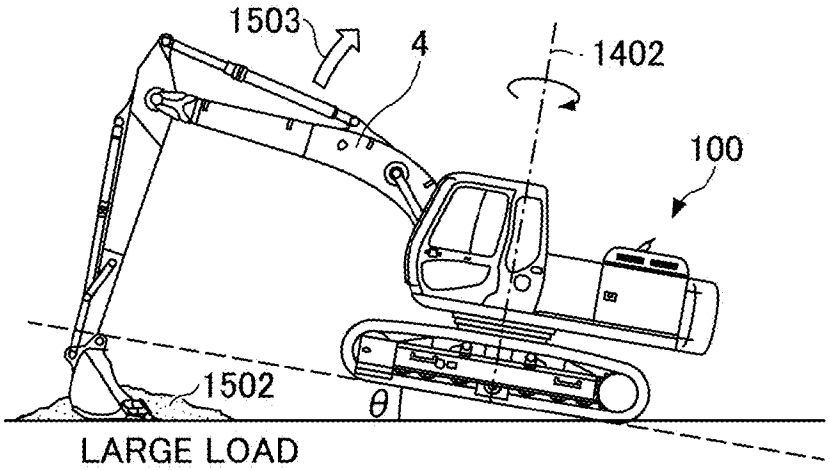
FIG. 5B is a view illustrating movement of a boom at a large load during slewing in the excavator according to the one embodiment.
Figure 5A:
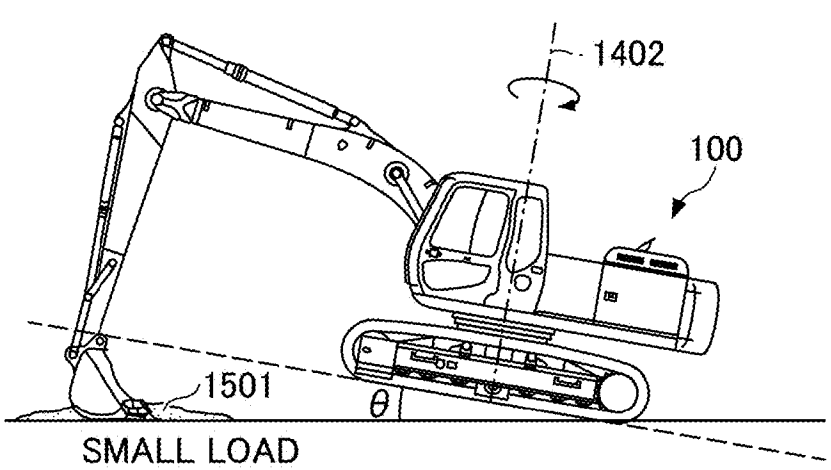
FIG. 5A is a view illustrating movement of a boom at a small load during slewing in the excavator according to the one embodiment.

FIGS. 5A and 5B are views illustrating the movement of the boom 4 in accordance with how much load is applied during slewing to the excavator 100 according to the present embodiment. In the example illustrated in FIG. 5A, during slewing about the slewing axis 1402, the load applied to the excavator 100 is small because the amount of earth and sand 1501 being removed by the bucket 6 is small.

In the example illustrated in FIG. 5B, the load applied to the excavator 100 during slewing is large because the amount of earth and sand 1502 being removed by the bucket 6 is large. In this case, the slewing speed of the upper slewing body 3 may decrease or the slewing of the upper slewing body 3 may stop.

Therefore, when the slewing load is large, the movement control part 305 according to the present embodiment raises the boom 4.

Specifically, the obtainment part 302 obtains a detection result obtained by the slewing pressure sensor (the rightward slewing pressure sensor S10R or the leftward slewing pressure sensor S10L) corresponding to the current slewing direction.

Then, the movement control part 305 determines whether or not the slewing load in accordance with the detection result obtained by the slewing pressure sensor (the rightward slewing pressure sensor S10R or the leftward slewing pressure sensor S10L) is larger than a first threshold during slewing. When the movement control part 305 determines that the slewing load is larger than the first threshold, the movement control part 305 controls the raising of the boom 4 as indicated by an arrow 1503. For example, the movement control part 305 controls the raising of the boom 4 such that the height of the bucket 6 is raised by 1 centimeter (cm) or more and 2 centimeters (cm) or less. The present embodiment illustrates an example of the raising of the boom 4, and does not intend any limitation to the raising of the boom 4 such that the height of the bucket 6 is raised by 1 cm or more and 2 cm or less. The raising of the boom 4 may be controlled individually for each embodiment.

Also, the condition for raising the boom 4 is not limited to the determination in accordance with the slewing load. For example, the condition for raising the boom 4 may be a determination in accordance with the amount of an operation for performing slewing and the slewing speed, or may be a determination in accordance with a combination of the amount of an operation for performing slewing, the slewing load, and the slewing speed. For example, the movement control part 305 may determine that the condition for raising the boom 4 is satisfied when the movement control part 305 determines that the slewing load increases and the slewing speed decreases despite the amount of an operation for performing slewing being constant. As another example, the movement control part 305 may determine that the condition for raising the boom 4 is satisfied when the movement control part 305 determines that the slewing load increases and the slewing speed decreases.

As described above, the movement control part 305 according to the present embodiment raises the boom 4 during slewing of the upper slewing body 3 in accordance with the current state, such as, for example, the slewing load applied by the slewing to the upper slewing body 3. The slewing load can be reduced by raising the boom 4, and thus it is possible to suppress stopping of the slewing, lowering of the slewing speed, or the like.

Also, when the slewing load becomes lower after raising the boom 4, the movement control part 305 performs control to return the position of the bucket 6 by lowering the boom 4.

As a specific example, after raising the boom 4, the movement control part 305 according to the present embodiment lowers the boom 4 when the movement control part 305 determines that the slewing load applied by the slewing to the upper slewing body 3 is smaller than a second threshold. The second threshold is a value smaller than the first threshold, and is a threshold determined individually for each embodiment. In the present embodiment, by lowering the boom 4, the movement control part 305 can bring the bucket 6 closer to the plane to be shaped. Thus, shaping that is desired by the operator can substantially be achieved. Therefore, accuracy of the shaping can be improved.

Further, in the present embodiment, the operation receiving part 301 may receive an operation to move the arm 5 during slewing while the MC switch is being pressed.

Figure 6:
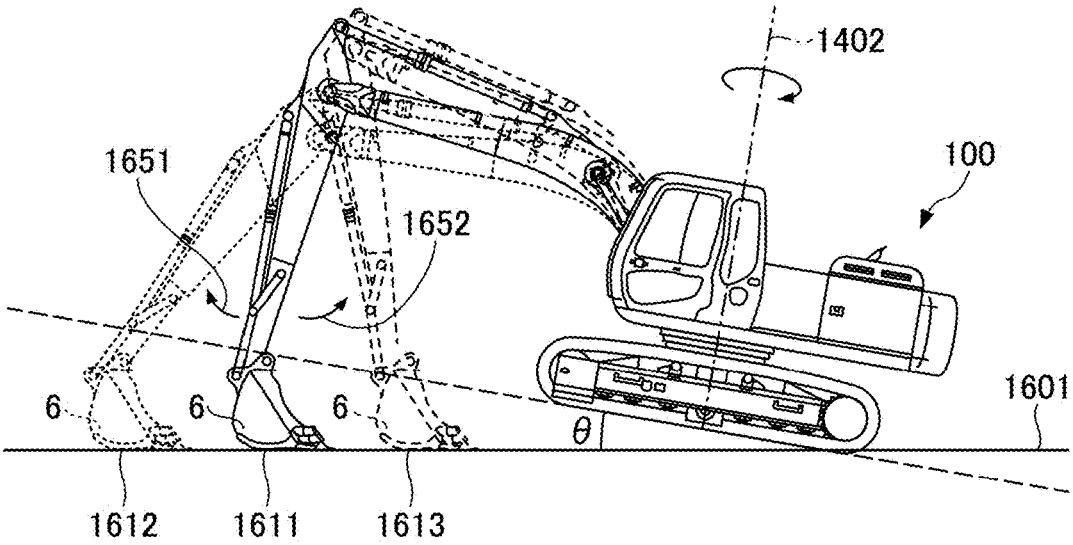
FIG. 6 is a view illustrating the control, by the controller according to the one embodiment, of the height of the bucket in response to receiving an operation to move an arm.

FIG. 6 is a view illustrating control, by the controller 30 according to the present embodiment, of the height of the bucket 6 in response to receiving an operation to move the arm 5. In the example illustrated in FIG. 6, the bucket 6 is assumed to be at a position 1611. When the operation receiving part 301 receives an operation to open the arm 5, the movement control part 305 opens the arm 5 as indicated by an arrow 1651, and lowers the boom 4 such that the bucket 6 is maintained to be at the height of ground 1601. Further, the movement control part 305 controls the angle of the bucket 6 such that the back surface 6*b* of the bucket 6 is substantially parallel to the ground 1601. As a result, the bucket 6 moves to a position 1612 at which the back surface 6*b* of the bucket 6 is in contact with the ground 1601.

On the other hand, when the operation receiving part 301 receives an operation to close the arm 5, the movement control part 305 closes the arm 5 as indicated by an arrow 1652, and raises the boom 4 such that the bucket 6 is maintained to be at the height of the ground 1601. Further, the movement control part 305 controls the angle of the bucket 6 such that the back surface 6*b* of the bucket 6 is substantially parallel to the ground 1601. As a result, the bucket 6 moves to a position 1613 at which the back surface 6*b* of the bucket 6 is in contact with the ground 1601.

The movement control part 305 according to the present embodiment is not limited to controlling both of the movement of the boom 4 and the angle of the bucket 6 when closing or opening the arm 5. The movement control part 305 may control only one of the movement of the boom 4 or the angle of the bucket 6. That is, even if only one of these controls is performed, the operator's operational burden can be reduced.

When closing or opening the arm 5 in accordance with the operation received by the operation device 26 during slewing of the upper slewing body 3, the movement control part 305 according to the present embodiment preforms either or both of maintaining the height of the back surface 6*b* of the bucket 6 to be the height of the ground (an example of the predetermined reference plane) 1601, and controlling the angle of the bucket 6 in accordance with the ground 1601.

In the present embodiment, the operator can level a desired place on the ground 1601 by opening or closing the arm 5 during slewing. For example, it is possible to perform control to move the bucket 6 to a place to be leveled, or control to move the bucket 6 from a place where the ground need not to be leveled. Further, the movement control part 305 can level the ground 1601 in a wide range by causing the movement of the arm 5 to follow the operation for the arm 5. Therefore, the controller 30 according to the present embodiment can improve the work efficiency by performing the above-described control.

Further, the movement control part 305 controls, during slewing of the upper slewing body 3, the angle of the bucket 6 in accordance with opening or closing of the bucket 6 based on a relationship between the ground and the back surface 6*b* of the bucket 6. For example, when the back surface 6*b* of the bucket 6 is tilted with respect to the ground by the movement of the boom 4 or the movement of the arm 5 while the MC switch is being pressed, the movement control part 305 opens or closes the bucket 6 such that the back surface 6*b* of the bucket 6 is substantially parallel to the ground. The method of adjusting the angle of the bucket 6 may be a well-known method. For example, a tilt angle of the back surface 6*b* of the bucket 6 with respect to the ground may be detected in accordance with the angle of the attachment AT, and the angle of the bucket 6 may be adjusted in accordance with the detection result. This can adjust the positional relationship between the back surface 6*b* of the bucket 6 and the ground, and thus the ground can be appropriately leveled with the back surface 6*b*. Therefore, accuracy of the leveling of the ground can be improved.

The output control part 306 displays, on the display device D1, a section that is leveled through slewing. Specific contents to be displayed will be described below.

Figure 7:
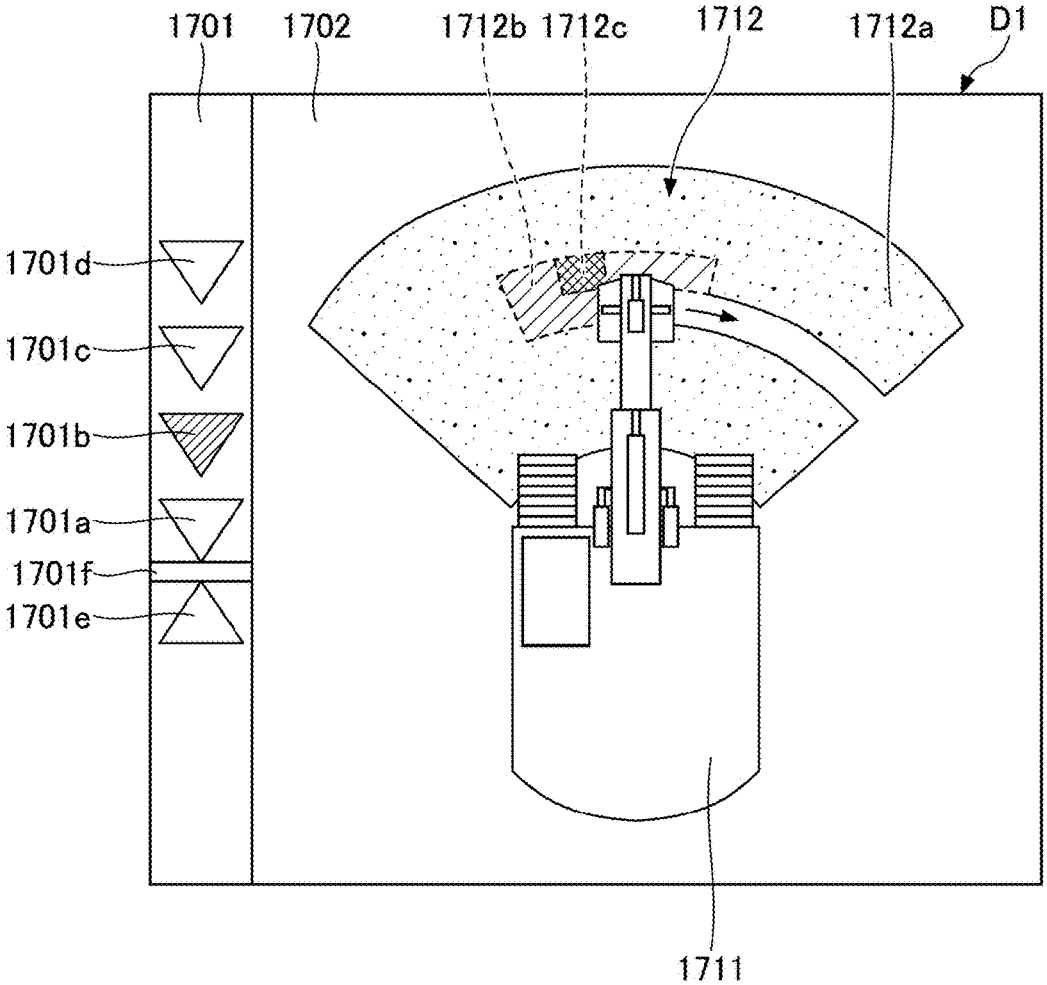
FIG. 7 is a view illustrating an example of a screen displayed on a display device by an output control part according to the one embodiment.

FIG. 7 is a view illustrating an example of a screen displayed on the display device D1 by the output control part 306 according to the present embodiment. In the example illustrated in FIG. 7, a bucket height display section 1701 and a ground leveling status display section 1702 are displayed.

The bucket height display section 1701 is a section for displaying the current height of the bucket 6. A target segment 1701*f* indicates the height of the ground to be leveled. A plurality of icons 1701*a* to 1701*e* are icons each indicating the current height of the bucket 6. One of the plurality of icons 1701*a* to 1701*e* is displayed in a manner different from that in which the other icons are displayed. The icon displayed in the different manner indicates the current height of the bucket 6. FIG. 7 illustrates an example in which the icon 1701*b* is displayed in a manner different from that in which the other icons 1701*a* and 1701*c* to 1701*e* are displayed. In the example illustrated in FIG. 7, the color of the icon of interest is made different as an example in which a display mode is made different. However, displaying the icon of interest in a different color is by no means a limitation. For example, the shape or the like of an icon may be made different.

The icon 1701*a* indicates the position of the bucket 6 that is appropriate for leveling the ground indicated by the target segment 1701*f*.

The icon 1701*b* indicates the height of the bucket 6 when the boom 4 is raised once from the height of the bucket 6 indicated by the icon 1701*a*. That is, the bucket height display section 1701 illustrated in FIG. 7 indicates that the boom 4 is raised once by the excavator 100.

The icon 1701*c* indicates the height of the bucket 6 when the boom 4 is raised once from the height of the bucket 6 indicated by the icon 1701*b*. The icon 1701*d* indicates the height of the bucket 6 when the boom 4 is raised once from the height of the bucket 6 indicated by the icon 1701*c*. That is, the bucket 6 moves away from the ground as the icon 1701*a* is changed to the icon 1701*d*.

The icon 1701*e* indicates the height of the bucket 6 when the boom 4 is lowered once from the height of the bucket 6 indicated by the icon 1701*a*. The icon 1701*e* indicates that the bucket 6 moves below the ground to be leveled.

The output control part 306 performs switching of the display mode of the icons 1701*a* to 1701*e* every time the boom 4 is raised during slewing. Further, the output control part 306 outputs an alarm sound from the speaker A1 every time the boom 4 is raised during slewing.

When the boom 4 is raised in this manner, the output control part 306 provides an operator with a notification. Therefore, the operator can recognize that the boom 4 has been raised. Further, the operator can recognize the current height of the bucket 6 by referring to the bucket height display section 1701. The operator can recognize the current status in the ground leveling work, leading to an improvement in convenience.

The ground leveling status display section 1702 illustrates a section in which the ground is leveled with the bucket 6 during slewing in the excavator 100 in response to receiving an operation to slew while receiving pressing of the MC switch. The ground leveling status display section 1702 illustrates a display image 1711 of the excavator 100, and a leveled ground display section 1712. The ground leveling status display section 1702 may overlap a leveled ground section with a bird's-eye view image in accordance with image information obtained by the photographing device S6. The obtained image information may include one or more selected from among: image information obtained by photographing a space frontward of the excavator 100 with the camera S6F; image information obtained by photographing a space leftward (which may be specifically a space frontward and leftward) of the excavator 100 with the camera S6L; image information obtained by photographing a space rightward (which may be specifically a space frontward and rightward) of the excavator 100 with the camera S6R; and image information obtained by photographing a space rearward of the excavator 100 with the camera S6B.

The display image 1711 of the excavator 100 displays the current status of the excavator 100 in accordance with the slewing angle, the boom angle, the arm angle, and the bucket angle of the excavator 100. Therefore, the operator can recognize the current status of the excavator 100 by referring to the display image 1711.

The leveled ground display section 1712 illustrates a section leveled with the side surface of the bucket 6 of the excavator 100. The leveled ground display section 1712 makes a display mode different in accordance with the height of the bucket 6 at the time the ground is leveled.

A first display section 1712*a* is a section in which the ground is leveled with the bucket 6 positioned at a height indicated by the icon 1701*a*, in other words, a section in which the ground is leveled with the bucket 6 positioned at a height appropriate for leveling the ground indicated by the target segment 1701*f*.

A second display section 1712*b* is a section in which the ground is leveled with the bucket 6 positioned at a height indicated by the icon 1701*b*, in other words, a section in which the ground is leveled with the bucket 6 after the boom 4 is raised once.

A third display section 1712*c* is a section in which the ground is leveled with the bucket 6 positioned at a height indicated by the icon 1701*c*, in other words, a section in which the ground is leveled with the bucket 6 after the boom 4 is raised twice.

In this manner, the output control part 306 displays, on the display device D1, the leveled ground display section 1712 in which the ground is leveled with the bucket 6 through slewing. The operator can recognize a section leveled by the excavator 100 by referring to the leveling status display section 1702.

Further, in the leveled ground display section 1712 in which the ground is leveled with the bucket 6 through slewing, the output control part 306 uses different colors in accordance with the height of the bucket 6 at the time of leveling the ground. The operator can recognize the height of earth and sand in the surroundings by referring to the leveled ground display section 1712. Further, the operator can recognize a section to be leveled again in order to equalize the height of the ground. By referring to the leveled ground display section 1712, the operator can recognize a result of the ground leveling work, and perform work based on the result. This can suppress occurrence of construction defects. Therefore, the controller 30 according to the present embodiment can improve accuracy of the leveling work and reduce a burden on the operator.

The screen example illustrated in FIG. 7 is just an example, and does not intend any limitation to this screen. For example, the output control part 306 is not limited to a mode of simultaneously displaying the bucket height display section 1701 and the leveling status display section 1702, and may display either the bucket height display section 1701 or the leveling status display section 1702. Also, the output control part 306 may display either or both of the bucket height display section 1701 and the leveling status display section 1702, along with monitoring information of the surroundings, such as image information obtained by the photographing device S6. Further, the output control part 306 may display either or both of the bucket height display section 1701 and the leveling status display section 1702, along with information indicating the current status of the excavator 100.

Figure 8:
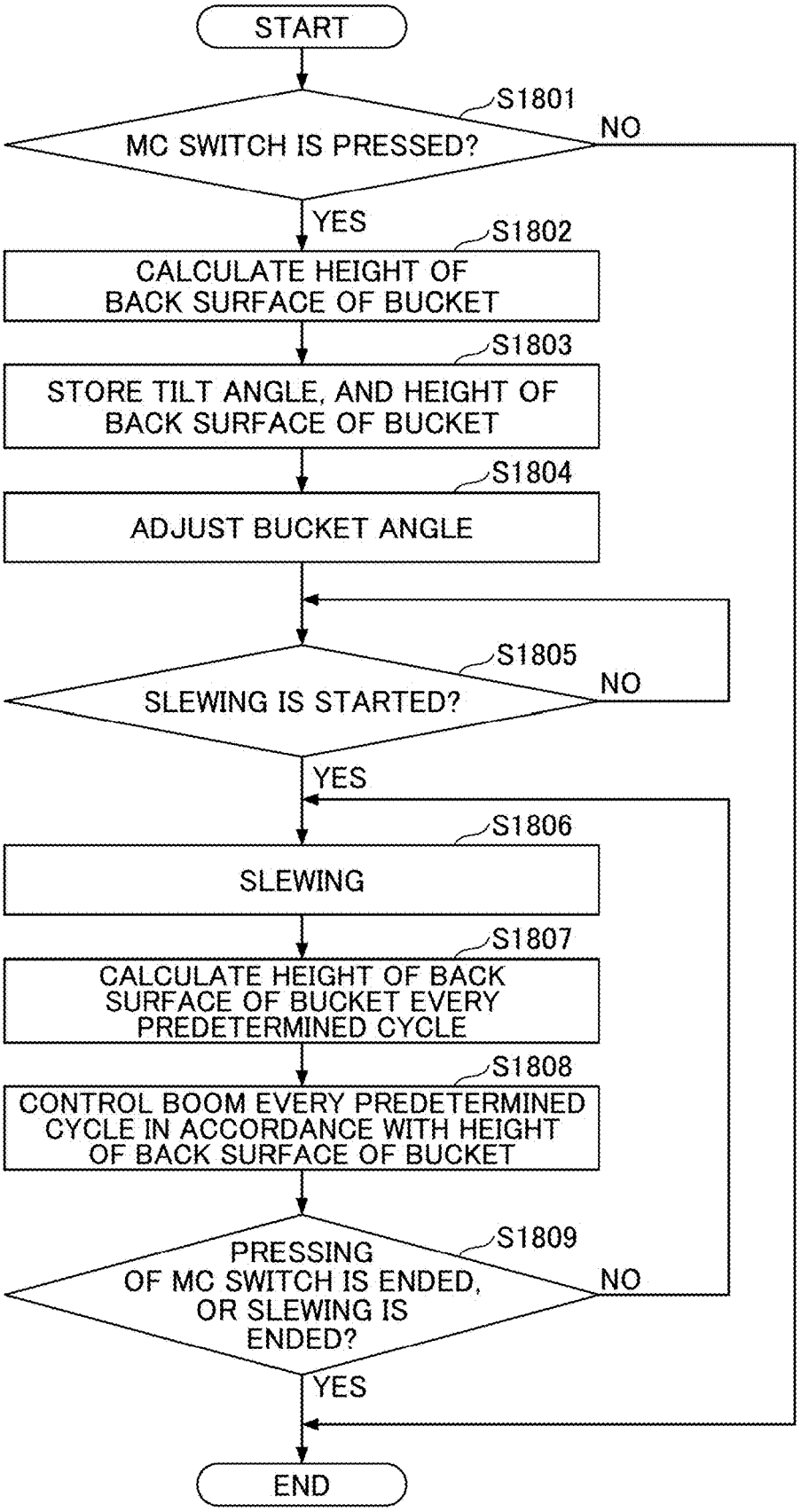
FIG. 8 is a first flowchart illustrating a processing procedure through which the controller according to the one embodiment levels the ground through slewing with a reference being a height of the bucket when an MC switch is pressed.

Next, a processing procedure performed by the controller 30 according to the present embodiment will be described. FIG. 8 is a first flowchart illustrating a processing procedure through which the controller 30 according to the present embodiment levels the ground through slewing with a reference being the height of the bucket 6 when the MC switch is pressed.

First, the operation receiving part 301 determines whether or not pressing of the MC switch is received (S1801). If the operation receiving part 301 determines that no pressing of the MC switch is received (S1801: NO), the process is ended.

If the operation receiving part 301 determines that pressing of the MC switch is received (S1801: YES), the calculation part 303 calculates the height of the back surface 6*b* of the bucket 6 in the reference coordinate system in accordance with the tilt angle of the excavator 100 obtained from the machine body tilt sensor S4 and the angle of the attachment AT obtained from the angle sensor of the attachment AT (e.g., the boom angle, the arm angle, and the bucket angle) (S1802).

The storage part 304 stores the tilt angle of the excavator 100 and the height of the back surface 6*b* of the bucket 6 in the auxiliary storage device 47 (S1803). The height of the bucket 6 stored in the auxiliary storage device 47 is the height of the reference plane.

The movement control part 305 adjusts the bucket angle such that the back surface 6*b* of the bucket 6 is substantially parallel to the ground (e.g., the horizontal plane) (S1804).

The operation receiving part 301 determines whether or not an operation to start slewing is received (S1805). If the operation receiving part 301 determines that no operation to start slewing is received (S1805: NO), the process is repeated until an operation to start slewing is received.

If the operation receiving part 301 determines that an operation to start slewing is received (S1805: YES), the movement control part 305 performs slewing of the upper slewing body 3 (S1806).

The calculation part 303 calculates the current height of the back surface 6*b* of the bucket 6 in the reference coordinate system in accordance with the tilt angle of the excavator 100 obtained from the machine body tilt sensor S4 and the angle of the attachment AT obtained from the angle sensor of the attachment AT (e.g., the boom angle, the arm angle, and the bucket angle) every predetermined cycle (S1807).

The movement control part 305 controls the boom 4 in accordance with the calculated height of the back surface 6*b* every predetermined cycle (S1808). Specifically, when the calculated height of the back surface 6*b* is different from the height of the back surface 6*b* of the bucket 6 stored in the storage part 304, the movement control part 305 raises or lowers the boom 4 such that the calculated height of the back surface 6*b* substantially coincides with the height of the back surface 6*b* of the bucket 6 stored in the storage part 304. Further, the movement control part 305 opens or closes the bucket 6 every predetermined cycle such that the back surface 6*b* of the bucket 6 is substantially parallel to the ground to be leveled.

Then, the operation receiving part 301 determines whether or not the end of the pressing of the MC switch or the end of the slewing is received (S1809). If the operation receiving part 301 determines that the pressing of the MC switch continues and the slewing continues (S1809: NO), the operation receiving part 301 performs the process from S1806 again.

On the other hand, if the operation receiving part 301 determines that the end of the pressing of the MC switch or the end of the slewing is received (S1809: YES), the process is ended.

By the above-described control performed by the controller 30 according to the present embodiment, the back surface 6*b* of the bucket 6 is controlled to follow the ground to be leveled even if the excavator 100 is tilted. This enables leveling of the ground.

However, the controller 30 may perform control in accordance with a state of the ground to be leveled or an operation performed by an operator.

Figure 9:
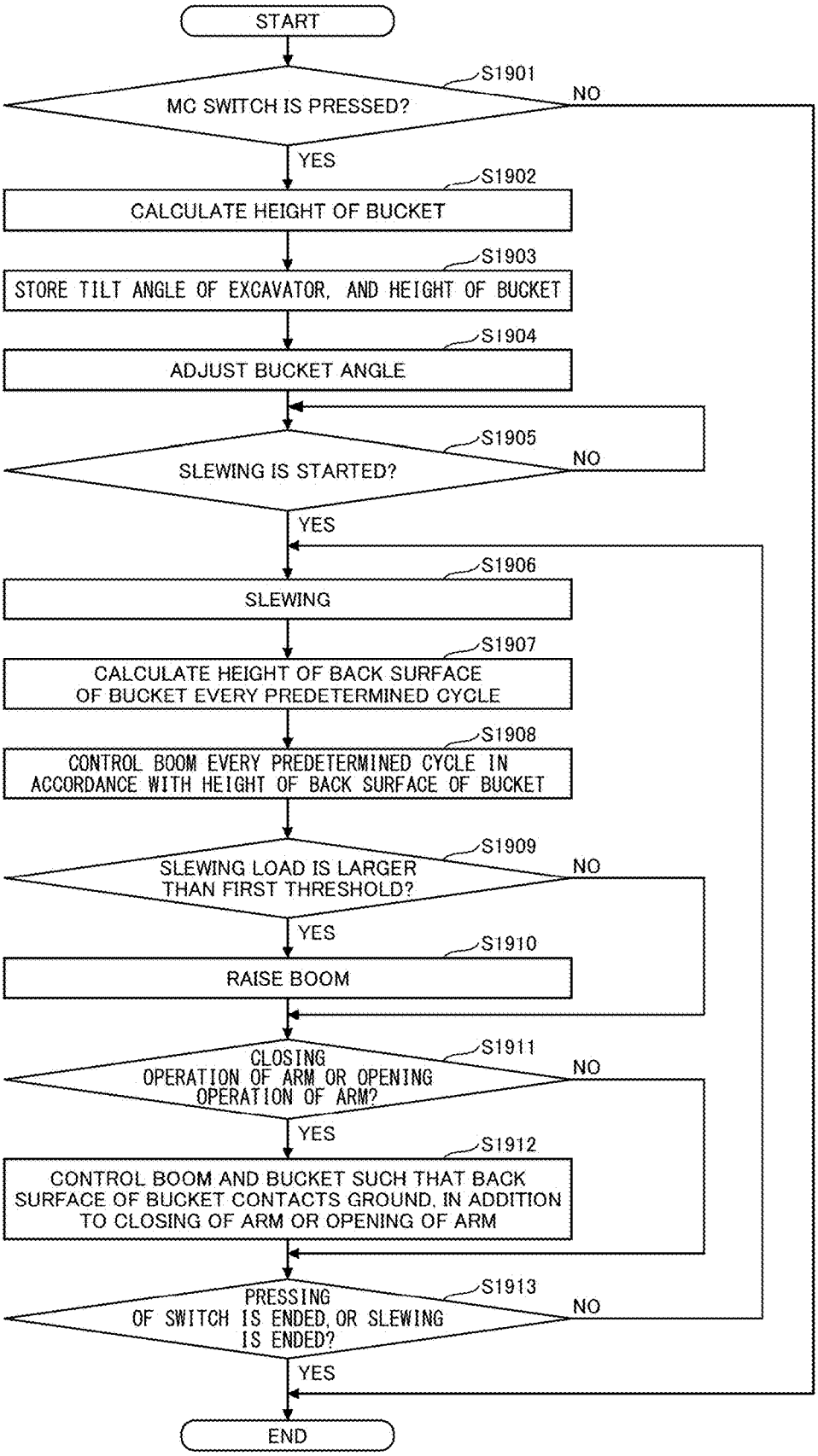
FIG. 9 is a second flowchart illustrating a processing procedure through which the controller according to the one embodiment levels the ground through slewing with a reference being a height of the bucket when an MC switch is pressed.

Next, the processing procedure performed by the controller 30 according to the present embodiment will be described. FIG. 9 is a second flowchart illustrating a processing procedure through which the controller 30 according to the present embodiment levels the ground through slewing with a reference being the height of the bucket 6 when the MC switch is pressed.

First, the operation receiving part 301 determines whether or not pressing of the MC switch is received (S1901). If the operation receiving part 301 determines that no pressing of the MC switch is received (S1901: NO), the process is ended.

If the operation receiving part 301 determines that pressing of the MC switch is received (S1901: YES), the calculation part 303 calculates the height of the back surface 6*b* of the bucket 6 in the reference coordinate system in accordance with the tilt angle of the excavator 100 obtained from the machine body tilt sensor S4 and the angle of the attachment AT obtained from the angle sensor of the attachment AT (e.g., the boom angle, the arm angle, and the bucket angle) (S1902).

The storage part 304 stores the tilt angle of the excavator 100 and the height of the back surface 6*b* of the bucket 6 in the auxiliary storage device 47 (S1903). The height of the bucket 6 stored in the auxiliary storage device 47 is the height of the reference plane.

The movement control part 305 adjusts the bucket angle such that the back surface 6*b* of the bucket 6 is substantially parallel to the ground (e.g., the horizontal plane) (S1904).

The operation receiving part 301 determines whether or not an operation to start slewing is received (S1905). If the operation receiving part 301 determines that no operation to start slewing is received (S1905: NO), the process is repeated until an operation to start slewing is received.

If the operation receiving part 301 determines that an operation to start slewing is received (S1905: YES), the movement control part 305 performs slewing of the upper slewing body 3 (S1906).

The calculation part 303 calculates the current height of the back surface 6*b* of the bucket 6 in the reference coordinate system in accordance with the tilt angle of the excavator 100 obtained from the machine body tilt sensor S4 and the angle of the attachment AT obtained from the angle sensor of the attachment AT (e.g., the boom angle, the arm angle, and the bucket angle) every predetermined cycle (S1907).

The movement control part 305 controls the boom 4 in accordance with the calculated height of the back surface 6*b* every predetermined cycle (S1908). Specifically, when the calculated height of the back surface 6*b* is different from the height of the back surface 6*b* of the bucket 6 stored in the storage part 304, similar to S1808 in FIG. 8, the movement control part 305 raises or lowers the boom 4 such that the calculated height of the back surface 6*b* substantially coincides with the height of the back surface 6*b* of the bucket 6 stored in the storage part 304. However, when the boom 4 is raised in S1910, which will be described below, the movement control part 305 determines whether or not the slewing load detected by the slewing pressure sensor (the rightward slewing pressure sensor S10R or the leftward slewing pressure sensor S10L) corresponding to the current slewing direction is smaller than the second threshold (the second threshold<the first threshold). When the movement control part 305 determines that the slewing load is smaller than the second threshold, the movement control part 305 lowers the boom 4 such that the height of the bucket 6 is lowered by 1 cm or more and 2 cm or less. That is, when the slewing load is smaller after the boom 4 is raised, the movement control part 305 lowers the boom 4, thereby returning the height of the back surface 6*b* to the original height.

The movement control part 305 determines whether or not the slewing load detected by the slewing pressure sensor (the rightward slewing pressure sensor S10R or the leftward slewing pressure sensor S10L) corresponding to the current slewing direction is larger than the first threshold (S1909). If the movement control part 305 determines that the slewing load is equal to or less than the first threshold (S1909: NO), the process proceeds to S1911. The first threshold is a threshold determined in accordance with the embodiment, such as in accordance with performance of the excavator 100.

On the other hand, if the movement control part 305 determines that the slewing load is larger than the first threshold (S1909: YES), the movement control part 305 raises the boom 4 such that the height of the bucket 6 is raised by 1 cm or more and 2 cm or less (S1910).

The operation receiving part 301 determines whether or not an operation to open or close the arm 5 is received (S1911). If the operation receiving part 301 determines that no operation to open or close the arm 5 is received (S1911: NO), the process proceeds to S1913.

On the other hand, if the operation receiving part 301 determines that an operation to open or close the arm 5 is received (S1911: YES), the movement control part 305 controls the boom 4 and the bucket 6 such that the back surface 6*b* of the bucket 6 contacts the ground to be leveled, along with opening or closing the arm 5 in accordance with the operation (S1912).

Then, the operation receiving part 301 determines whether or not the end of the pressing of the MC switch or the end of the operation to perform slewing is received (S1913). If the operation receiving part 301 determines that the pressing of the MC switch continues and the operation to perform slewing continues (S1913: NO), the operation receiving part 301 performs the process from S1906 again.

On the other hand, if the operation receiving part 301 determines that the end of the pressing of the MC switch or the end of the operation to perform slewing is received (S1913: YES), the process is ended.

According to the processing procedure illustrated in FIG. 9, the slewing load applied to the excavator 100 can be reduced by raising or lowering the boom 4 in accordance with a change in the ground to be shaped. Further, even when an operation to close or open the arm 5 is received from an operator, the back surface 6*b* of the bucket 6 can be maintained to be in contact with the ground to be shaped, thereby improving accuracy of shaping work.

The present embodiment has been described using an example of controlling the height of the bucket 6 such that the back surface 6*b* of the bucket 6 contacts the ground. However, the control of the height of the bucket 6 according to the present embodiment is not limited to the control to contact the back surface 6*b* of the bucket 6 with the ground. The control of the height of the bucket 6 may be any control in accordance with work performed by the excavator 100 during slewing.

Another Embodiment

The above-described embodiment has been described based on an example in which an operator performs an operation such that the back surface 6*b* of the bucket 6 contacts a plane of the ground to be leveled (an example of the reference plane), followed by leveling the ground during slewing through the machine control function. However, the above-described embodiment does not intend any limitation to a method in which an operator identifies a plane of the ground to be leveled. Thus, the another embodiment is an example in which the ground leveling work is performed by causing the back surface 6*b* of the bucket 6 to follow a work target plane (an example of the predetermined reference plane) indicated by design data stored in the design data storage 47A.

Figure 10:
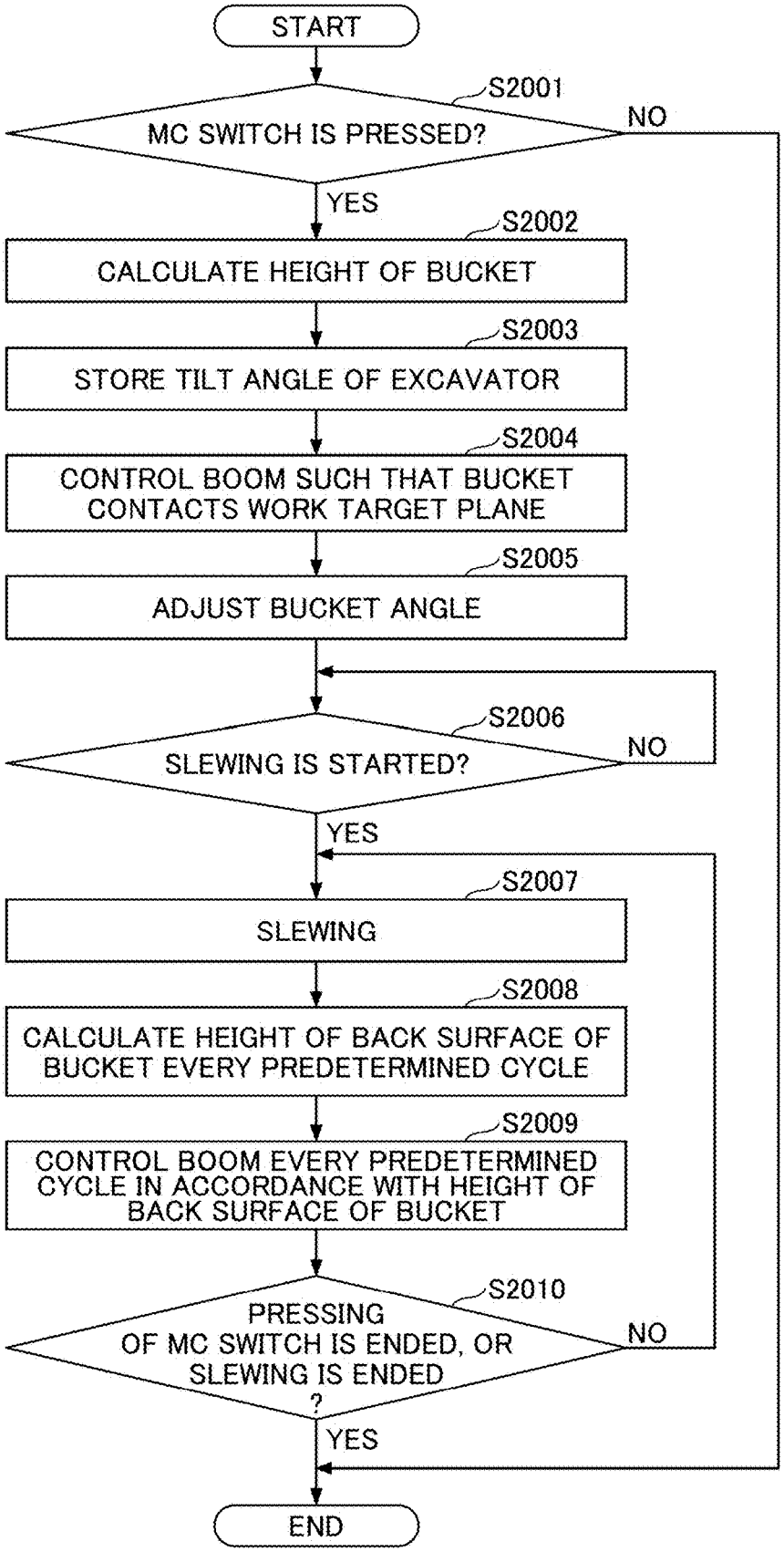
FIG. 10 is a flowchart illustrating a processing procedure through which a controller according to another embodiment levels a work target plane indicated by design data through slewing.

Next, a processing procedure performed by the controller 30 according to the present embodiment will be described. FIG. 10 is a flowchart illustrating a processing procedure through which the controller 30 according to the present embodiment levels the work target plane indicated by design data through slewing.

First, the operation receiving part 301 determines whether or not pressing of the MC switch is received (S2001). If the operation receiving part 301 determines that no pressing of the MC switch is received (S2001: NO), the process is ended.

If the operation receiving part 301 determines that pressing of the MC switch is received (S2001: YES), the calculation part 303 calculates the height of the back surface 6*b* of the bucket 6 in the reference coordinate system in accordance with the tilt angle of the excavator 100 obtained from the machine body tilt sensor S4 and the angle of the attachment AT obtained from the angle sensor of the attachment AT (e.g., the boom angle, the arm angle, and the bucket angle) (S2002).

The storage part 304 stores the tilt angle of the excavator 100 in the auxiliary storage device 47 (S2003).

The movement control part 305 performs control to move (e.g., lower) the boom 4 such that the bucket 6 contacts the work target plane indicated by design data (S2004).

Further, the movement control part 305 adjusts the bucket angle such that the back surface 6*b* of the bucket 6 is substantially parallel to the work target plane (S2005).

The operation receiving part 301 determines whether or not an operation to start slewing is received (S2006). If the operation receiving part 301 determines that no operation to start slewing is received (S2006: NO), the process is repeated until an operation to start slewing is received.

If the operation receiving part 301 determines that an operation to start slewing is received (S2006: YES), the movement control part 305 performs slewing of the upper slewing body 3 (S2007).

The calculation part 303 calculates the current height of the bucket 6 in the reference coordinate system in accordance with the tilt angle of the excavator 100 obtained from the machine body tilt sensor S4 and the angle of the attachment AT obtained from the angle sensor of the attachment AT (e.g., the boom angle, the arm angle, and the bucket angle) every predetermined cycle (S2008).

The movement control part 305 controls the boom 4 in accordance with the calculated height of the back surface 6*b* every predetermined cycle (S2009). Specifically, when the calculated height of the back surface 6*b* is different from the height of the work target plane indicated by design data, the movement control part 305 raises or lowers the boom 4 such that the calculated height of the back surface 6*b* substantially coincides with the work target plane. Further, the movement control part 305 opens or closes the bucket 6 every predetermined cycle such that the back surface 6*b* of the bucket 6 is substantially parallel to the work target plane.

Then, the operation receiving part 301 determines whether or not the end of pressing of the MC switch or the end of the operation to perform slewing is received (S2010). If the operation receiving part 301 determines that the pressing of the MC switch continues and the operation to perform slewing continues (S2010: NO), the operation receiving part 301 performs the process from S2007 again.

On the other hand, if the operation receiving part 301 determines that the end of the pressing of the MC switch or the end of the operation to perform slewing is received (S2010: YES), the process is ended.

By the above-described control performed by the controller 30 according to the present embodiment, the back surface 6*b* of the bucket 6 is controlled to follow the work target plane even if the excavator 100 is tilted. This enables shaping of the ground into a shape indicated by the work target plane.

According to the present embodiment, the boom 4 is raised or lowered so as to follow the work target plane, and the bucket 6 is opened or closed such that the back surface 6*b* of the bucket 6 substantially coincides with the work target plane. In other words, by the above-described control performed by the controller 30 according to the present embodiment, even if the work target plane is tilted with respect to the horizontal plane in the reference coordinate system, the back surface 6*b* of the bucket 6 can be caused to follow the tilted work target plane. This enables leveling of the ground.

In this manner, the controller 30 according to the present embodiment can perform the ground leveling work by using the back surface 6*b* of the bucket 6 during slewing even if the ground is tilted.

The excavator 100 according to the present embodiment is controlled such that the back surface 6*b* of the bucket 6 follows the work target plane indicated by design data, and therefore an operator's operational burden for performing shaping work can be reduced.

Yet Another Embodiment

In yet another embodiment, a case in which an operator performs a remote operation of the excavator 100 will be described.

Figure 11:
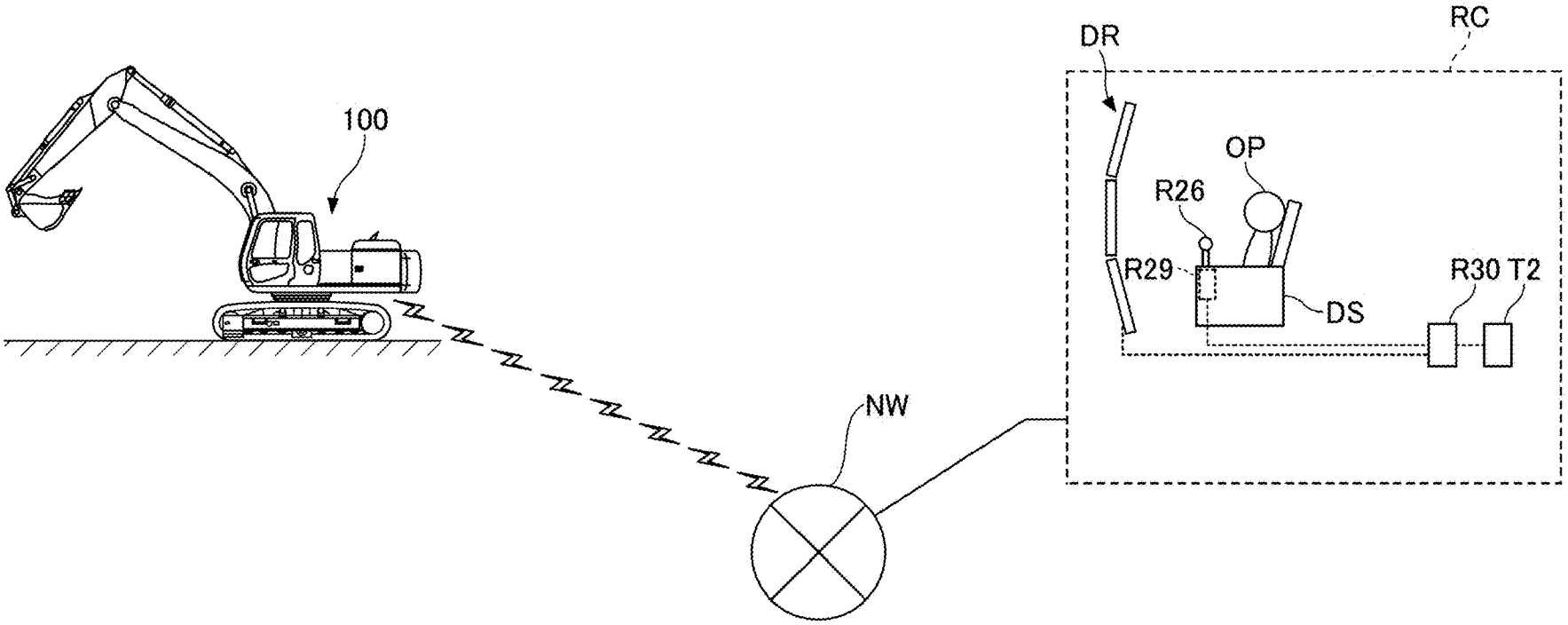
FIG. 11 is a schematic view illustrating a configuration example of a remote support system of an excavator according to yet another embodiment.

FIG. 11 is a schematic view illustrating a configuration example of a remote support system (an example of the excavator control system) SYS of the excavator 100 according to the present embodiment. In the example illustrated in FIG. 11, the excavator 100 and a remote control room RC are connected via a communication network NW. This can achieve receiving and transmitting of information between the excavator 100 and the remote control room RC.

The excavator 100 transmits detection results from various sensors, provided to the excavator 100, to the remote control room RC by using the communication device T1 provided to the excavator 100. For example, the excavator 100 transmits, to the remote control room RC, image information obtained by the photographing device S6.

In the remote support system SYS according to the present embodiment, the remote control room RC is provided. The remote control room RC includes a display device DR, the operation device R26, an operation sensor R29, an operation seat DS, a remote controller R30, and a communication device T2.

The display device DR is provided in order for an operator OP in the remote control room RC to visually recognize the surroundings of the excavator 100.

The operator OP at the operation seat DS of the remote control room RC performs an operation on the operation device R26. The operation sensor R29 is configured to detect operation contents received by the operation device R26. The remote controller R30 is configured to generate a control signal corresponding to the operation contents.

The remote controller R30 also receives pressing of the MC switch provided at the end of the operation device R26. The remote controller R30 also generates a control signal indicating whether or not the MC switch is pressed.

Then, the communication device T2 transmits the generated control signal to the excavator 100. The remote controller R30 transmits the control signal, thereby enabling a remote operation of the excavator 100.

The controller 30 of the excavator 100 controls the excavator 100 in accordance with the received control signal. For example, the controller 30 can recognize whether or not the MC switch is pressed, in accordance with the received control signal. Further, the controller 30 can recognize whether or not an operation to perform slewing is performed, in accordance with the received control signal.

The controller 30 of the excavator 100 performs control similar to that in the above-described embodiments, in accordance with the recognition result.

Thus, according to the present embodiment, even if the operator OP at the operation seat DS is present in the remote control room RC, the ground leveling work can be performed through slewing in the excavator 100.

The above-described embodiments and modified examples have been described using an example in which the bucket 6 is attached as an end attachment. However, the above-described embodiments and modified examples do not limit the end attachment to the bucket 6. For example, a slope-forming bucket or the like may be applicable.

Effects

According to the above-described embodiments, even if the excavator 100 is tilted, the ground can be leveled with a predetermined portion of the bucket 6 through slewing in the excavator 100. Therefore, an operator need not to adjust the angle of the attachment AT in accordance with the tilt of the excavator 100, and thus an operational burden can be reduced. Hence, even an inexperienced operator could readily perform ground leveling work.

The excavator 100 according to the above-described embodiments controls the height of a predetermined portion of the bucket 6. Thus, a plane of the ground to be leveled can be appropriately leveled. Therefore, accuracy of leveling of the ground can be improved. In the past, when the ground was leveled with a bucket through slewing, there was a need to perform adjustments, such as, for example, setting the excavator so as to be horizontal. On the other hand, according to the above-described embodiments, in which the controller 30 performs the above-described control, adjustments, such as, for example, setting the excavator 100 so as to be horizontal, are not required. This can reduce an operational burden.

Although the embodiments of the excavator and the excavator control system according to the present disclosure have been described above, the present disclosure is not limited to the above-described embodiments. Various changes, modifications, substitutions, additions, deletions, and combinations are possible within the scope of the claims recited. These also fall within the technical scope of the present disclosure.

What is claimed is:

1. An excavator, comprising:

a lower traveling body;

an upper slewing body that is slewably mounted on the lower traveling body;

a boom that is attached to the upper slewing body;

an arm that is attached to an end of the boom;

an end attachment that is attached to an end of the arm;

a tilt sensor configured to detect a tilt of the excavator; and a control part including a memory and a processor connected to the memory, the processor being configured to control a height of the end attachment during slewing of the upper slewing body, in accordance with a detection result obtained by the tilt sensor.

2. The excavator according to claim 1, wherein the processor is configured to, in response to pressing of a predetermined switch, control the height of the end attachment during the slewing of the upper slewing body, in accordance with the detection result obtained by the tilt sensor.

3. The excavator according to claim 1, wherein
the processor is configured to control the boom during the slewing of the upper slewing body such that the height of the end attachment is maintained to be a height of a predetermined reference plane.

4. The excavator according to claim 3, wherein
the height of the predetermined reference plane corresponds to a height of ground after being leveled by the end attachment during the slewing of the upper slewing body.

5. The excavator according to claim 3, wherein
the processor is configured to control an angle of the end attachment in accordance with the predetermined reference plane during the slewing of the upper slewing body.

6. The excavator according to claim 3, wherein
the processor is configured to perform either or both of:
(i) maintaining the height of the end attachment to be the height of the predetermined reference plane; and
(ii) controlling an angle of the end attachment in accordance with the predetermined reference plane,
in a case in which the arm is closed or opened in accordance with an operation received by an operation device during the slewing of the upper slewing body.

7. The excavator according to claim 1, wherein
the processor is configured to, during the slewing of the upper slewing body, suppress excavating by the end attachment and compaction by the end attachment.

8. The excavator according to claim 1, wherein
the processor is configured to control, during the slewing of the upper slewing body, the height of the end attachment such that an object existing on ground is removable with a side surface of the end attachment.

9. The excavator according to claim 8, wherein
the object to be removed with the side surface of the end attachment during the slewing of the upper slewing body is earth and sand of the ground to be leveled by the end attachment.

10. The excavator according to claim 1, wherein
the processor is configured to, during the slewing of the upper slewing body, raise the boom in accordance with a load applied to the upper slewing body due to the slewing of the upper slewing body.

11. The excavator according to claim 10, wherein
the processor is configured to, after raising the boom, lower the boom in accordance with the load applied to the upper slewing body due to the slewing of the upper slewing body.

12. The excavator according to claim 10, wherein
the processor is configured to provide a notification in response to raising the boom.

13. The excavator according to claim 1, wherein
the processor is configured to display, on a display device, one or more sections each leveled by the end attachment through the slewing of the upper slewing body.

14. The excavator according to claim 13, wherein
the processor is configured to display the sections, each leveled by the end attachment through the slewing of the upper slewing body, in different manners in accordance with the height of the end attachment.

15. An excavator control system, comprising:
an excavator including a lower traveling body, an upper slewing body that is slewably mounted on the lower traveling body, a boom that is attached to the upper slewing body, an arm that is attached to an end of the boom, an end attachment that is attached to an end of the arm, and a tilt sensor configured to detect a tilt of the excavator;
an operation device configured to receive pressing of a predetermined switch; and
a control part including a memory and a processor connected to the memory, the processor being configured to, in response to the pressing of the predetermined switch, control a height of the end attachment during slewing of the upper slewing body, in accordance with a detection result obtained by the tilt sensor.

* * * * *